US009725940B2

(12) United States Patent
Lambright et al.

(10) Patent No.: US 9,725,940 B2
(45) Date of Patent: Aug. 8, 2017

(54) DOOR HINGE CLOSING MECHANISM

(71) Applicants: Michael Lambright, Goshen, IN (US); Michael Gzybowski, Ann Arbor, MI (US)

(72) Inventors: Michael Lambright, Goshen, IN (US); Michael Gzybowski, Ann Arbor, MI (US)

( * ) Notice: Subject to any disclaimer, the term of this patent is extended or adjusted under 35 U.S.C. 154(b) by 0 days.

(21) Appl. No.: 14/808,159

(22) Filed: Jul. 24, 2015

(65) Prior Publication Data

US 2016/0024827 A1 Jan. 28, 2016

Related U.S. Application Data

(60) Provisional application No. 62/028,791, filed on Jul. 24, 2014.

(51) Int. Cl.

| | |
|---|---|
| ***E05F 1/10*** | (2006.01) |
| ***E05F 1/12*** | (2006.01) |
| ***E06B 3/36*** | (2006.01) |
| ***E05F 3/20*** | (2006.01) |
| *E05D 3/02* | (2006.01) |

(52) U.S. Cl.

CPC ..... *E05F 1/123* (2013.01); *E05F 3/20* (2013.01); *E06B 3/36* (2013.01); *E05D 3/02* (2013.01); *Y10T 16/599* (2015.01)

(58) Field of Classification Search

CPC .... E05F 1/123; E05F 3/14; E05D 7/00; E05D 3/02; E06B 3/36; Y10T 16/5389; Y10T 16/276; Y10T 16/538

See application file for complete search history.

(56) References Cited

U.S. PATENT DOCUMENTS 3,022,536 A * 2/1962 Floehr ..... E05F 1/1033 105/286
3,952,365 A * 4/1976 Grisebach ..... E02F 9/006 16/52
4,104,761 A * 8/1978 Lyons ..... E05F 1/123 16/51
4,158,271 A * 6/1979 Barry ..... E05D 11/1078 16/75
4,358,870 A * 11/1982 Hong ..... E05F 3/20 16/53
4,646,472 A * 3/1987 Sugawara ..... E05F 1/123 16/238
4,696,078 A * 9/1987 Stromquist ..... E05F 1/123 16/301
4,845,811 A * 7/1989 Fargnier ..... E05F 1/123 16/301
4,905,347 A * 3/1990 Wroth ..... E05F 1/123 16/308

(Continued)

*Primary Examiner* — Justin Rephann

(57) ABSTRACT

A hinge assembly that includes a closure member such as a door and a torsion bar that extends between hinge assemblies about which the door pivots so that the torsion bar becomes twisted when the door is moved between a closed position and an open position. The twisting of the torsion bar creates potential energy in the torsion which can be used to open or close the door. A force adjustment mechanism is provided which releases built-up potential energy in the torsion bar in a controlled manner so as to close open the door in a controlled manner.

13 Claims, 27 Drawing Sheets

(56) References Cited

U.S. PATENT DOCUMENTS 4,953,260 A * 9/1990 Fargnier ..... E05F 1/123 16/308
5,109,571 A * 5/1992 Ohshima ..... A47K 13/10 16/284
5,152,029 A * 10/1992 Pai ..... E05D 5/10 16/54
5,228,240 A * 7/1993 Barroero ..... A47F 3/043 16/308
5,321,870 A * 6/1994 Wada ..... E05F 1/123 16/300
5,333,355 A * 8/1994 Beswick ..... E05F 1/123 16/300
5,606,773 A * 3/1997 Shappell ..... E05F 1/123 16/298
5,687,509 A * 11/1997 Barroero ..... A47F 3/043 16/308
5,771,540 A * 6/1998 Carpenter ..... G06F 1/1681 16/299
5,787,549 A * 8/1998 Soderlund ..... E05F 1/123 16/308
6,154,924 A * 12/2000 Woo ..... E05F 3/14 16/51
6,298,662 B1 * 10/2001 Vezain ..... B64G 1/222 60/527
7,287,799 B2 * 10/2007 Austin ..... B62D 33/0273 296/57.1
7,695,043 B2 * 4/2010 Zagoroff ..... B62D 33/03 296/50
8,745,820 B2 * 6/2014 Janak ..... E05F 3/12 16/50
9,115,519 B2 * 8/2015 Li ..... E05F 5/00
2002/0002884 A1 * 1/2002 Eromaki ..... G06F 1/1616 82/117
2002/0069483 A1 * 6/2002 Savolainen ..... G06F 1/1616 16/308
2004/0178651 A1 * 9/2004 Austin ..... B62D 33/0273 296/57.1
2005/0034269 A1 * 2/2005 Jinbo ..... E05D 11/1007 16/51
2005/0193523 A1 * 9/2005 Nam ..... E05D 11/06 16/330
2008/0168620 A1 * 7/2008 Hammerle ..... E05F 5/006 16/85
2008/0197652 A1 * 8/2008 Stratten ..... B62D 33/03 296/57.1
2009/0096246 A1 * 4/2009 Patzer ..... E05F 5/00 296/146.11
2009/0302630 A1 * 12/2009 Duffy ..... B62D 33/0273 296/57.1
2011/0214354 A1 * 9/2011 Talpe ..... E05F 3/14 49/324
2012/0117758 A1 * 5/2012 Walhorn ..... E05F 1/1253 16/321
2013/0283566 A1 * 10/2013 Wach ..... E05D 7/0415 16/245

* cited by examiner

4

DOOR HINGE CLOSING MECHANISM

RELATED APPLICATION

This application is based upon U.S. Provisional Application Ser. No. 62/028,791, filed Jul. 24, 2014 to which priority is claimed under 35 U.S.C. §120 and of which the entire specification is hereby expressly incorporated by reference

BACKGROUND

The present invention relates generally to door hinge mechanisms that provide for closing of doors automatically and which hinge mechanisms can be concealed in or aligned along a side, top or bottom of a door frame for aesthetic purposes.

For purposes of the present invention "door frame" refers to a stationary structure adjacent a door opening which may include a frame or other stationary structure that supports a closure member such as a door in a pivotal manner.

Vertically hung doors and especially commercial doors, are often provided with a closing mechanism that is attached between the tops of the doors and above the door frames.

These types of mechanisms typically include a hydraulic mechanism that is coupled above the door frame and an arm that is coupled between the top of a door and the hydraulic mechanism. The hydraulic mechanism allows the doors to opened and then utilizes hydraulic pressure that is built up when the door is open to pull the door closed.

There are a number of problems with known hydraulic door closing mechanisms, including periodic adjustments and the fact that the hydraulic force applied to the mounting screws tends to cause the mounting screws to come loose.

In addition the closing mechanism is bulky and unsightly, as it must necessarily be mounted above a door opening.

The present invention is directed to door closing mechanisms that can be aligned along the side, top or bottom of a door or in the framework surrounding or adjacent a door or within a door.

BRIEF SUMMARY

According to various features, characteristics and embodiments of the present invention which will become apparent as the description thereof proceeds, the present invention provides a door assembly having a door and a door frame, a door hinge mechanism, a torsion bar about which the door rotates between an open and a closed position wherein one end of the torsion bar is attached to the door frame so as not to rotate with respect to the door frame and another end of the torsion fear is fixedly attached to the door so as to become twisted as the door is pivoted between open and closed positions, whereby when the door is moved between the open and closed positions the torsion bar twists so as to build-up potential energy in the torsion bar, and a force adjustment mechanism which releases built-up potential energy in the torsion bar in a controlled manner so as to close or open the door in a controlled manner.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

The present invention is directed to door hinge mechanisms that provides for closing of a door automatically and which hinge mechanisms can be concealed or aligned along the side, top or bottom of a door frame or in a door for aesthetic purposes.

The door hinge mechanisms are based on the use of a torsion bar that functions as a hinge pin or axis of rotation and has one end attached in a fixed manner to a door and the other end attached in a fixed manner to a structure adjacent the door such as a door frame. The torsion bar can be external to the door and/or door frame, or can be provided within the door or door frame. A single torsion bar can be used which extends along a portion or the full length or width of the door or door frame. Otherwise two or more coaxial torsion bars can be used.

According to one embodiment as the door is opened the torsion bar twists and stores potential energy that is released as the door is closed and the torsion bar untwists.

The door hinge mechanism of the present invention includes a force adjusting mechanism or force releasing mechanism which releases the potential energy stored in the twisted torsion bar in a controlled manner.

The door hinge mechanism of the present invention can be provided either along the side of a door or concealed in the framework of a door or within a door. The door hinge mechanisms can be retrofitted to existing doors or configured to be installed together with new door installations.

According to a further embodiment of the present invention the door hinge mechanisms of the present invention can be used to pre-load doors such as cabinet doors so that the automatically open when released. In this embodiment the torsion bars are at least partially twisted when the doors are closed so that when the doors are released the potential energy stored in the twisted torsion bars rotate the doors to open about the torsion bars. In this embodiment a force adjusting mechanism can be used to prevent the doors from opening too quickly.

The hinge assemblies of the present invention can be used in conjunction with commercial pass doors, residential pass doors, entry doors, screen doors, storm doors, or virtually any type of door including but not limited to cabinet doors, storage doors or in conjunctions lids or windows, or any type of closure structure that pivots about a vertical, horizontal or angled axis, as will be apparent to those skilled in the art.

The invention will be hereafter described in reference to the figures in which similar elements are identified by similar reference numbers throughout the drawings and previously described elements are not repeatedly described when such repeated descriptions are not required for purposes of understanding the invention, based upon the previous descriptions.

Figure 1:
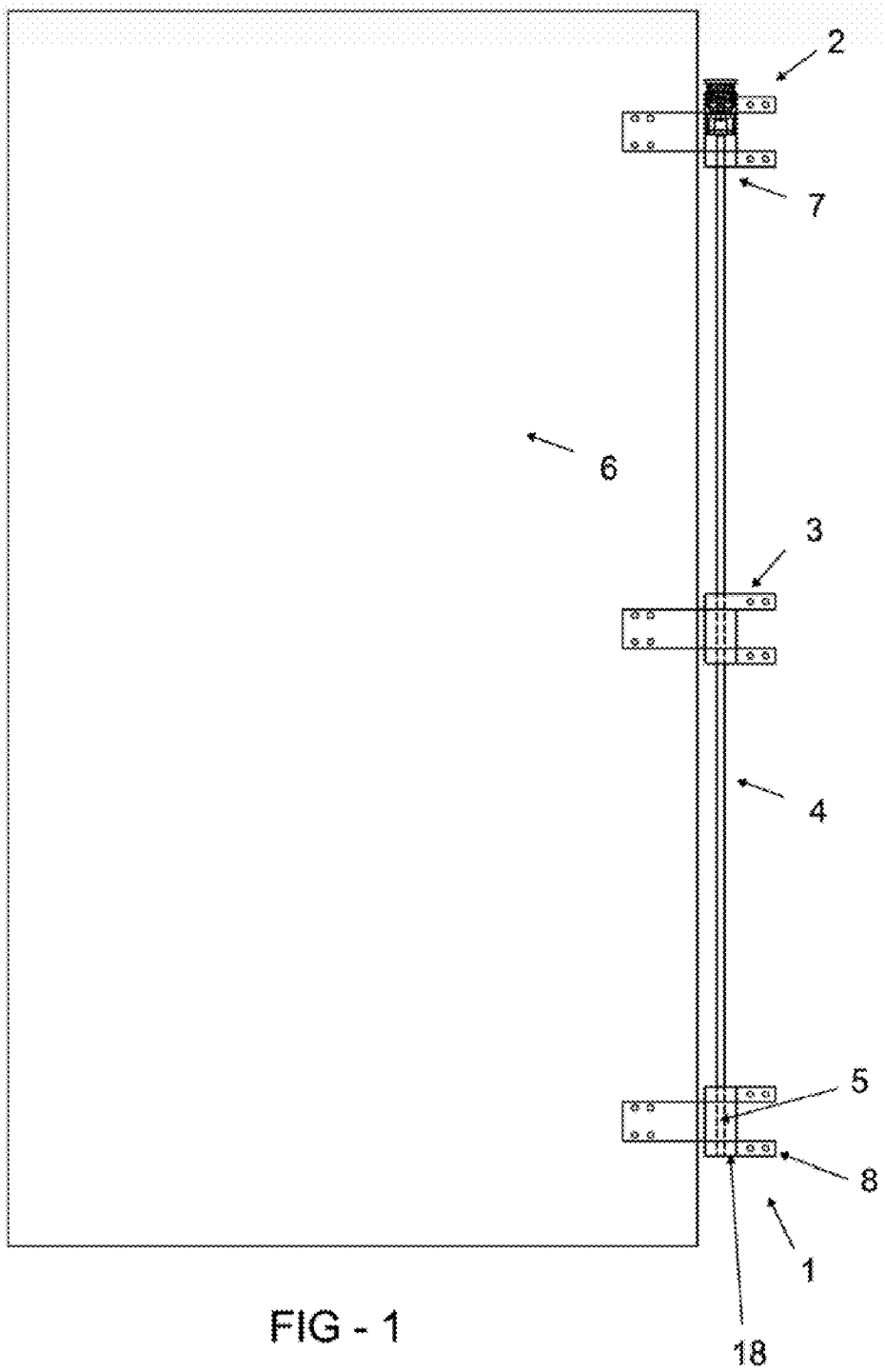
FIG. 1 is a plane view of a door that is coupled to a side frame by an external hinge assembly according to one embodiment of the present invention.

FIG. 1 is a plane view of a door that is coupled to a side frame by an external hinge assembly according to one embodiment of the present invention.

The hinge assembly of FIG. 1 includes a lower hinge 1 and an upper hinge assembly 2 that includes a force adjusting mechanism. In addition one or more intermediate hinges 3 (one shown) can be included.

A torsion bar 4 extends between the uppermost hinge assembly 2 and the lowermost hinge 1. In this embodiment depicted in FIG. 1, the lower end 5 of the torsion bar 4 is secured in a fixed manner to the framework adjacent the door 6 via the lower hinge 1 and the upper end 7 of the torsion bar 4 is secured in a fixed manner to the door 8 via the force adjusting mechanism as discussed in detail below.

In use when the door 6 is opened the torsion bar 4 gets twisted thereby storing potential energy in the torsion bar 4. The force adjusting mechanism allows the potential energy stored up in the torsion bar 4 to be released in an adjustable, controlled manner so as to return the door 6 to its closed position.

The torsion bar 4 functions as a hinge pivot axis in each of the hinge assembly 2 and hinges 1 and 3. In the lowermost hinge 1 the torsion bar 4 is attached in a secure, non-rotational manner to the lower hinge bracket 8.

Figure 2:
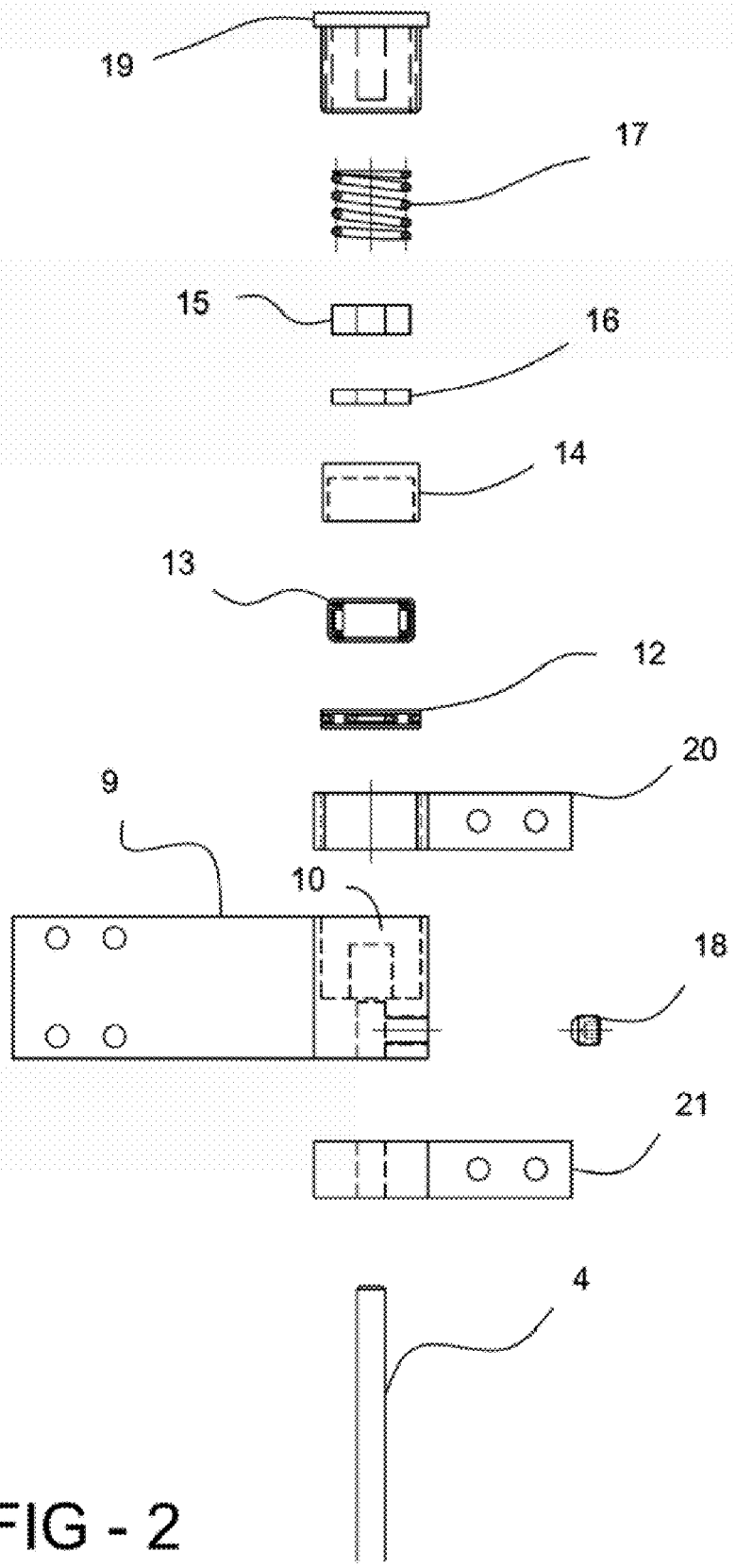
FIG. 2 is an exploded view of the force adjusting mechanism of the external hinge assembly of FIG. 1.
Figure 3:
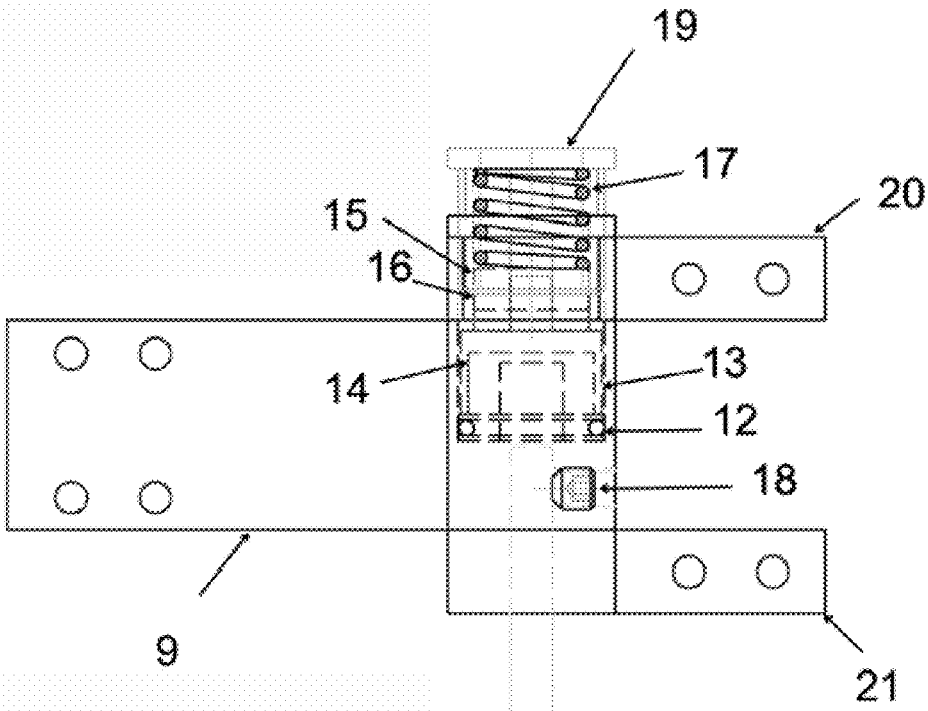
FIG. 3 is a side view of the force adjusting mechanism of the external hinge assembly of FIG. 1.

FIG. 2 is an exploded view of the force adjusting mechanism of the external hinge assembly of FIG. 1. FIG. 3 is a side view of the force adjusting mechanism of the external hinge assembly of FIG. 1.

The force adjusting mechanism in FIGS. 2 and 3 includes a pivot hinge arm 9 that is attached to door 6 and securely attached in a non-rotational manner to the upper end of the torsion bar 4. In order to secure the ends of the torsion bar to a lower hinge bracket (not shown) and pivot hinge arm 9 the ends of the torsion bar 4 can be configured to have a non-circular shape that is received in a complementarily shaped portion of the lower hinge bracket and upper pivot hinge arm 9 and secured therein with a set screw (See reference numeral 18).

As shown in FIG. 2 the pivot hinge arm 9 includes a stepped through bore 10 having a smaller lower diameter configured to receive the upper end of the torsion bar 4 therein and a larger upper diameter that is configured to receive the elements of the force adjusting mechanism.

The force adjusting mechanism include a thrust bearing 12 (or thrust washer) and a one-way roller clutch 13 that can be pushed down by pressure cup 14 against the stepped portion of through bore 10. The force that presses downward against pressure cup 14 is created by pressure plate 15 that presses down against friction disc 16 under the influence of compression spring 17. Adjustment nut 19 in turn adjusts the amount of force in compression spring 17. As depicted the adjustment nut 19 has centrally depending keyed (e.g. square shaped) protrusion that extends is through similarly shaped central bores in each of the pressure plate 15 and friction disc 16. The static hinge brackets which are attached to an adjacent door frame (not shown) are identified by reference numerals 20 and 21.

It is to be understood that in the embodiment of the invention depicted in FIGS. 1-3 the force adjusting mechanism could be provided in the lowermost hinge assembly rather that in the uppermost hinge assembly.

Figure 4:
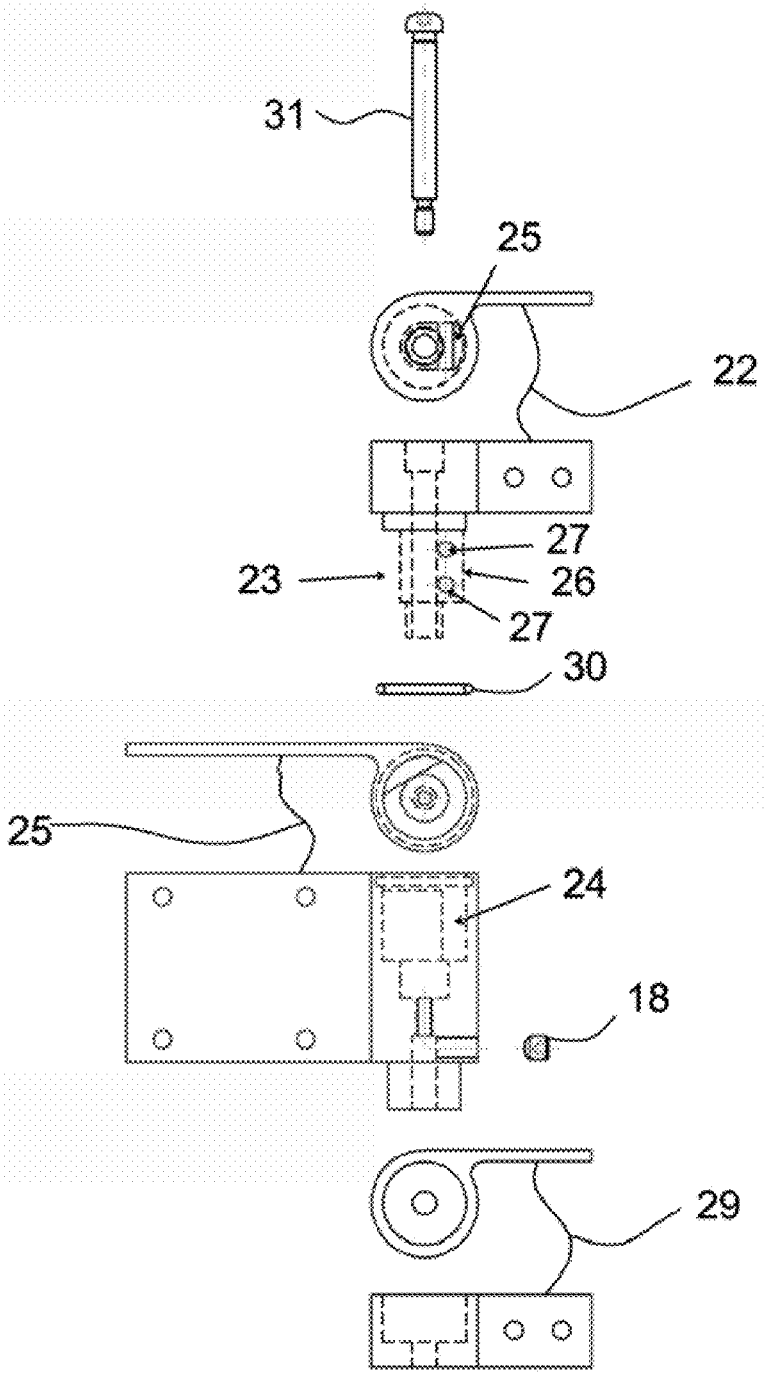
FIG. 4 is an exploded view of a force adjusting mechanism according to another embodiment of the present invention.
Figure 5:
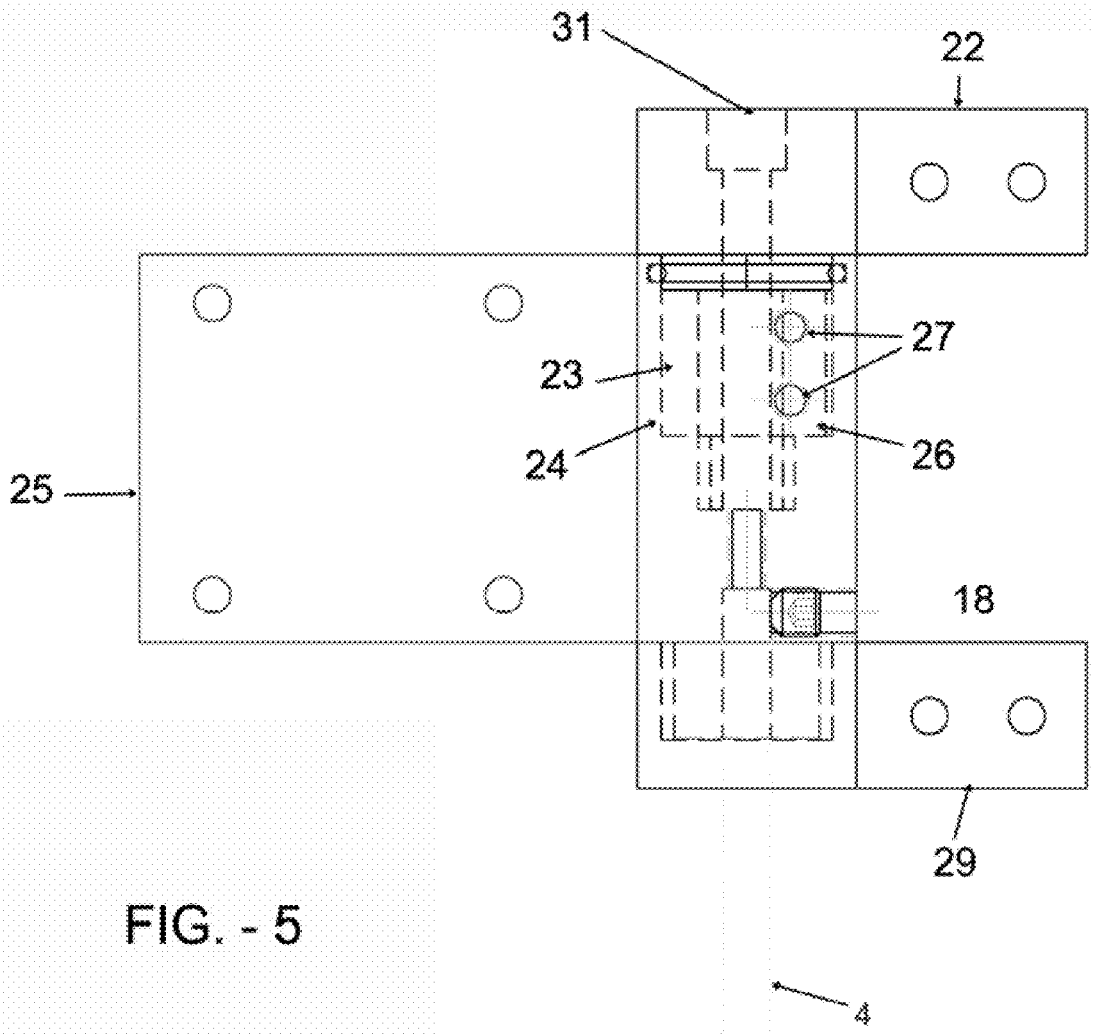
FIG. 5 is a side view of the force adjusting mechanism of FIG. 4.

FIG. 4 is an exploded view of a force adjusting mechanism according to another embodiment of the present invention. FIG. 5 is a side view of the force adjusting mechanism of FIG. 4.

The force adjusting mechanism of the embodiment of the invention depicted in FIGS. 4 and 5 includes a rotating piston housing that rotates about a piston that is formed on a static hinge bracket. In FIGS. 4 and 5 the static hinge bracket 22 is provided as part of the uppermost hinge assembly. The static hinge bracket 22, which is attached to an adjacent door frame, includes a piston 23 that extends downward to be received in a bore 24 provided in pivot hinge portion 25 that is attached to a door (not shown). As the door is rotated the pivot hinge portion 25 rotates about piston 23.

The piston 23 has a smaller diameter than bore 24 and a radial extension portion 26 that has a radius equal to the inner diameter of bore 24. The extension portion 26 includes two one-way valve passages 27, one of which allows fluid (such as hydraulic fluid) to freely flow there though when the door is opened and the pivot hinge portion 25 rotates about piston 23, and the other of which controls the amount of fluid that passes there through when the door is rotated in the closed direction. In further embodiments the inner diameter of bore 24 can have increased radial portions so as to allow fluid to flow around the end of extension portion 26 to vary the speed at which the door closes as desired. For example the providing a small arc circumferential portion of the bore with an increased radius relative to the position at which the door would be fully open will allow an initial quick release of hydraulic fluid around the extension portion thereby allowing the door to initially close quickly.

A torsion bar 4 extends through hinge bracket 29 and is fixed in a non-rotational manner to hinge portion 25. The opposite end of the torsion bar 4 is fixed to the door frame at a lower hinge assembly as discussed herein. The top end of the torsion bar 4 can be provided with a non-rotatable shape (e.g. square) that is complementarily shaped to a receiving bore in the hinge portion 25. In use as the door is opened the torsion bar 4 gets twisted thereby storing potential energy in the torsion bar 4. At the same time the fluid within the pivot hinge portion 25 flows freely through the one-way valve passage in the extension portion 26 of the piston 23 and collects on one side of the extension portion 26. The potential energy stored in the torsion bar 4 acts to rotate the pivot hinge portion 25 back to the door closed position; however the closing force is regulated by the one-way valve that controls the amount of fluid that passes there through when the door is rotated in the closed direction. As a result the closing of the door is controlled.

In FIGS. 4 and 5 an oil seal 30 is provided between the pivot hinge portion 25 and the static hinge bracket 22. In addition a shoulder screw 31 is shown which is used to secure the pivot hinge portion 25 and the static hinge bracket 22 together. Also shown in FIGS. 4 and 5 is a set screw 18 that is used to secure the end of the torsion bar 4 to the pivot hinge portion 25.

Other features of the external hinge assembly shown in FIGS. 4 and 5 such as a lowermost hinge and intermediate hinges are similar to those discussed above in reference to FIG. 1.

Further it is to be understood that in the embodiment of the invention depicted in FIGS. 4 and 5 the force adjusting mechanism could be provided in the lowermost hinge rather that in the uppermost hinge.

Figure 6:
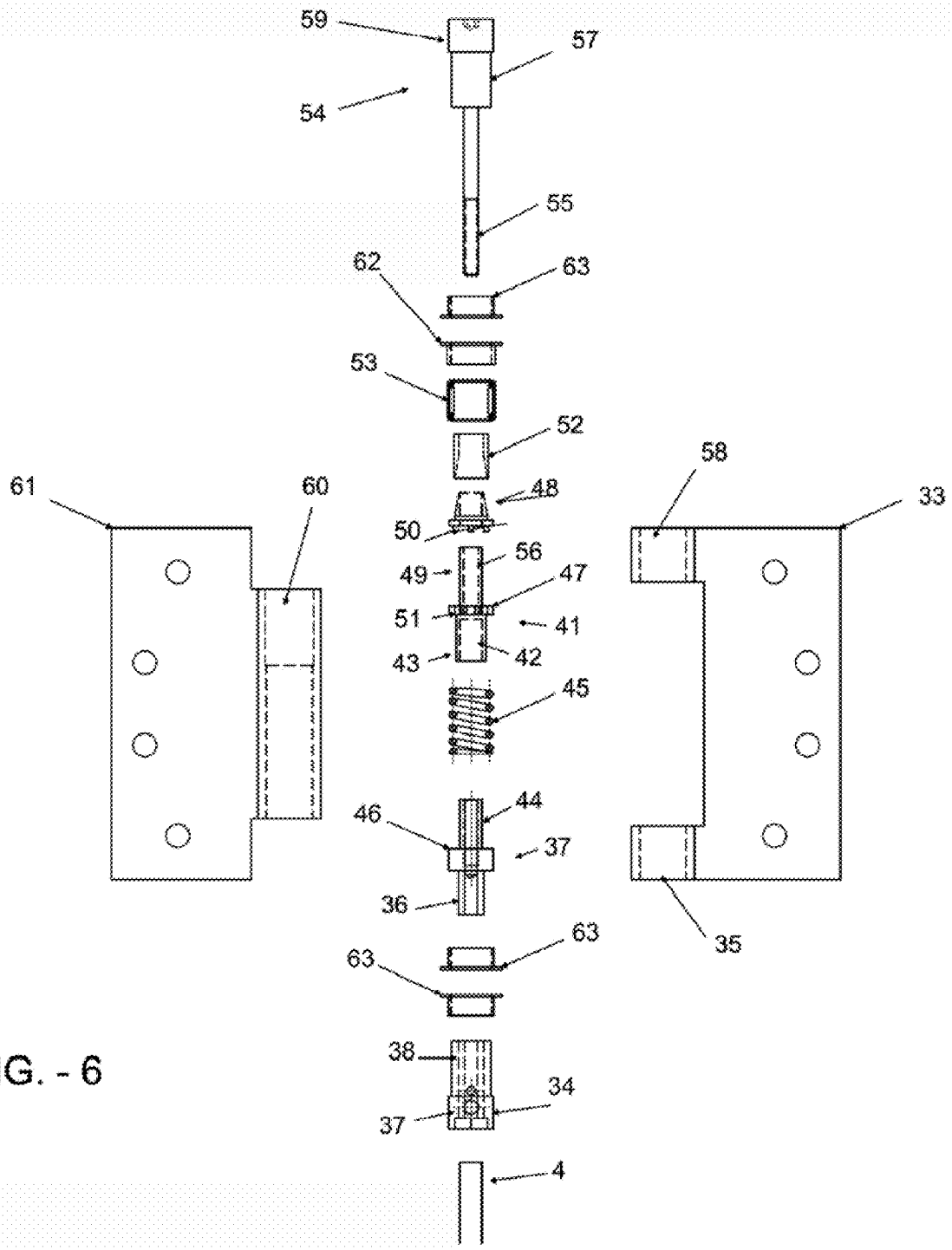
FIG. 6 is an exploded view of a force adjusting mechanism according to another embodiment of the present invention.
Figure 7:
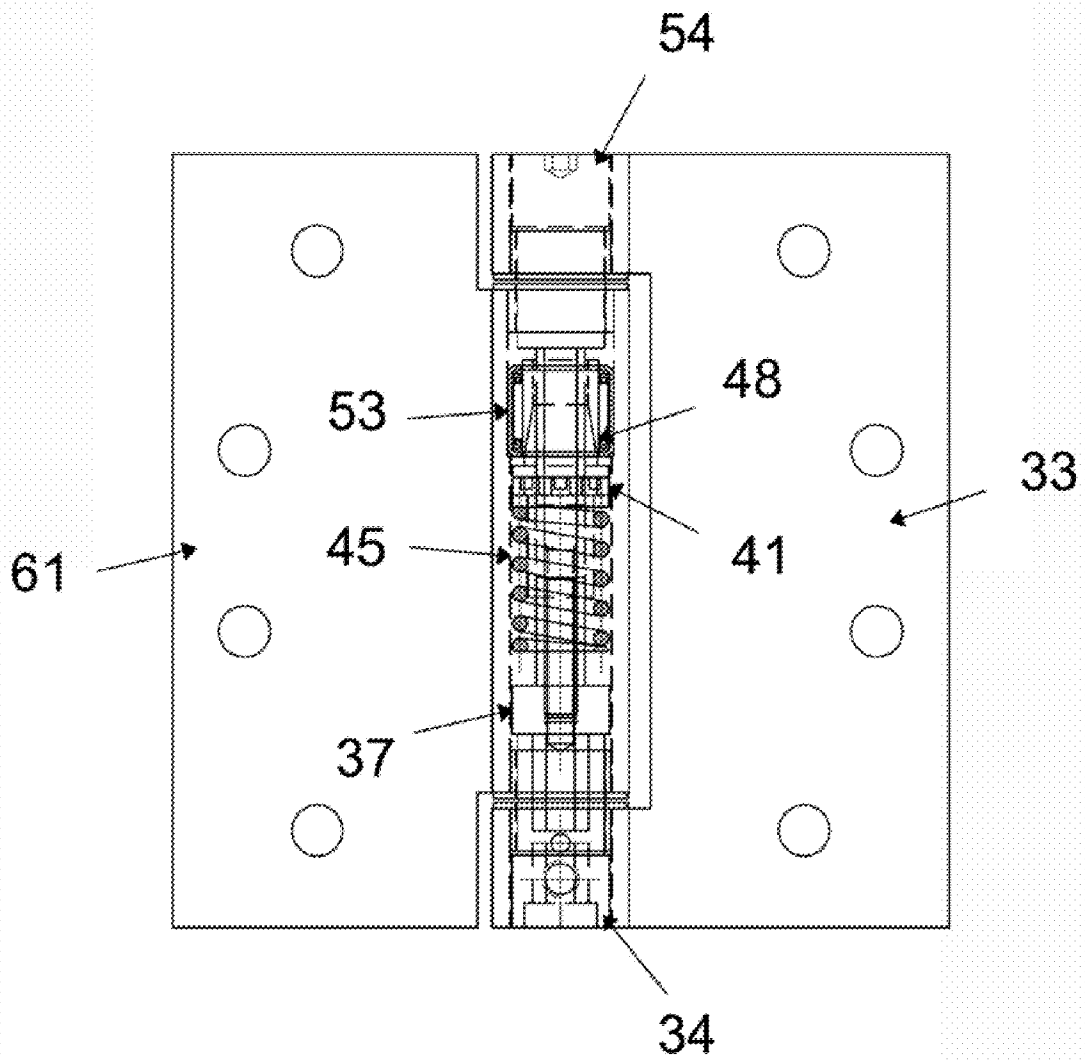
FIG. 7 is a side view of the force adjusting mechanism of FIG. 6.

FIG. 6 is an exploded view of a force adjusting mechanism according to another embodiment of the present invention. FIG. 7 is a side view of the force adjusting mechanism of FIG. 8.

The top end of the torsion bar 4 shown in FIG. 6 is held in a fixed, non-rotatable manner to pivotal hinge bracket 33 that is fixed to the door (not shown). The opposite end of the torsion bar 4 is attached to the doorframe (not show) so that the torsion bar 4 twists when the door is opened.

The top end of the torsion bar 4 is received into a lower coupling element 34 that has an outer diameter that is complementarily shaped to the inner diameter the lower bore 35 of the pivot hinge bracket 33 to be received therein and be pinned to prevent relative rotation therein. The lower portion 36 of an adjustment element 37 is received in a bore 38 in the top of the lower coupling element 34. The lower portion 36 of the adjustment element 37 has an outer cross-sectional shape that is complementarily shaped to the inner shape of the bore 38 in the top of the lower coupling element 34 to prevent the adjustment element 37 from rotating within the bore 38 in the top of the lower coupling element 34. Such a shape can be square, hexagonal, octagonal, etc. In the embodiment depicted in FIGS. 6 and 7 the lower coupling element 34 includes a set screw 39 and pin bore 40 which are used to secure the top end of the torsion bar 4 therein and pinning the adjustment element in bore 35 of pivotal hinge bracket 33.

An upper coupling element 41 is provided that has a lower inner bore 42 in a bottom portion 43 thereof that is configured to receive an upper portion 44 of the adjustment element 37. The upper portion 44 of the adjustment element 37 has an outer cross-sectional shape that is complementarily shaped to the inner shape of the lower inner bore 42 in the bottom portion 43 of the upper coupling element 41 to prevent the adjustment element 37 from rotating within the lower inner bore 42 in the bottom portion 43 of the upper coupling element 41. Such a shape can be square, hexagonal, octagonal, etc. In this regard it is noted that reference herein to hex-shaped structures that are provided to prevent rotation of elements can be square, hexagonal, octagonal, or have other non-circular shapes.

A coil spring 45 is located around the bottom portion 43 of the upper coupling element 41 and is contained between a flange 46 on the adjustment element 37 and a flange 47 on the upper coupling element 41.

A friction cone 48 is received over an upper portion 49 of the upper coupling element 41. The bottom of the friction cone 48 includes protrusions 50 that extent downward and are received in depressions or bores 51 in the flange 47 of the upper coupling element 41.

A friction collar 52 is provided over the friction cone 48 and a one-way clutch 53 is provided over the friction collar 62. A subassembly of the adjustment element 37, upper coupling element 41, coil spring 45, friction cone 48 and friction collar 52 is secured together by a threaded element 54 that has a lower externally threaded shaft 55 that is received in a complementarily internally threaded bore 56 in the top of the low adjustment element 37.

As can be understood from FIGS. 6 and 7 when the threaded element 54 is rotated so that the lower externally threaded shaft 55 moves deeper in the internally threaded bore 56 in the top of the adjustment element 37 more pressure is created between the friction collar 52 and the friction cone 48 by compressing spring 45. Adjustment of this pressure can be used to regulate or control the release of potential energy that is built up when the door is opened and the torsion bar 4 is twisted thus controlling the force or speed at which the door closes.

The top portion of the threaded element 54 includes a stepped outer surface having a smaller lower diameter 57 that is configured to be received in the upper bore 60 of the static hinge bracket 61 and a larger upper diameter 59 that is configured to be received in the upper bore 58 of the pivotal hinge bracket 33 that is fixed to the door. In addition the top of the threaded element 54 is provided with a tool receiving depression such as an allen wrench socket, screw driver head socket etc. or a protrusion to which a wrench can be coupled to turn the threaded element 54 and thereby adjust the friction that is applied by the force dampening mechanism. The threaded element 54 can be pinned so as not to rotate in upper bore 58 of the static hinge bracket 33. In which case rotating the subassembly discussed above with the pivotal hinge bracket 33 while preventing the threaded element 54 from rotating with the static hinge bracket 61 would cause change the pressure applied to spring 45.

FIGS. 6 and 7 further depict bushing (e.g. plastic bushing) 62 that is received in the top of the bore 60 provided in the static bracket 61 and bushings (e.g. plastic bushings) 63 that are received in the bottom of the bore provided in the static hinge bracket 61 and the top and bottom of the upper and lower bores 58 and 35 provided in the pivotal hinge bracket 33.

Figure 8:
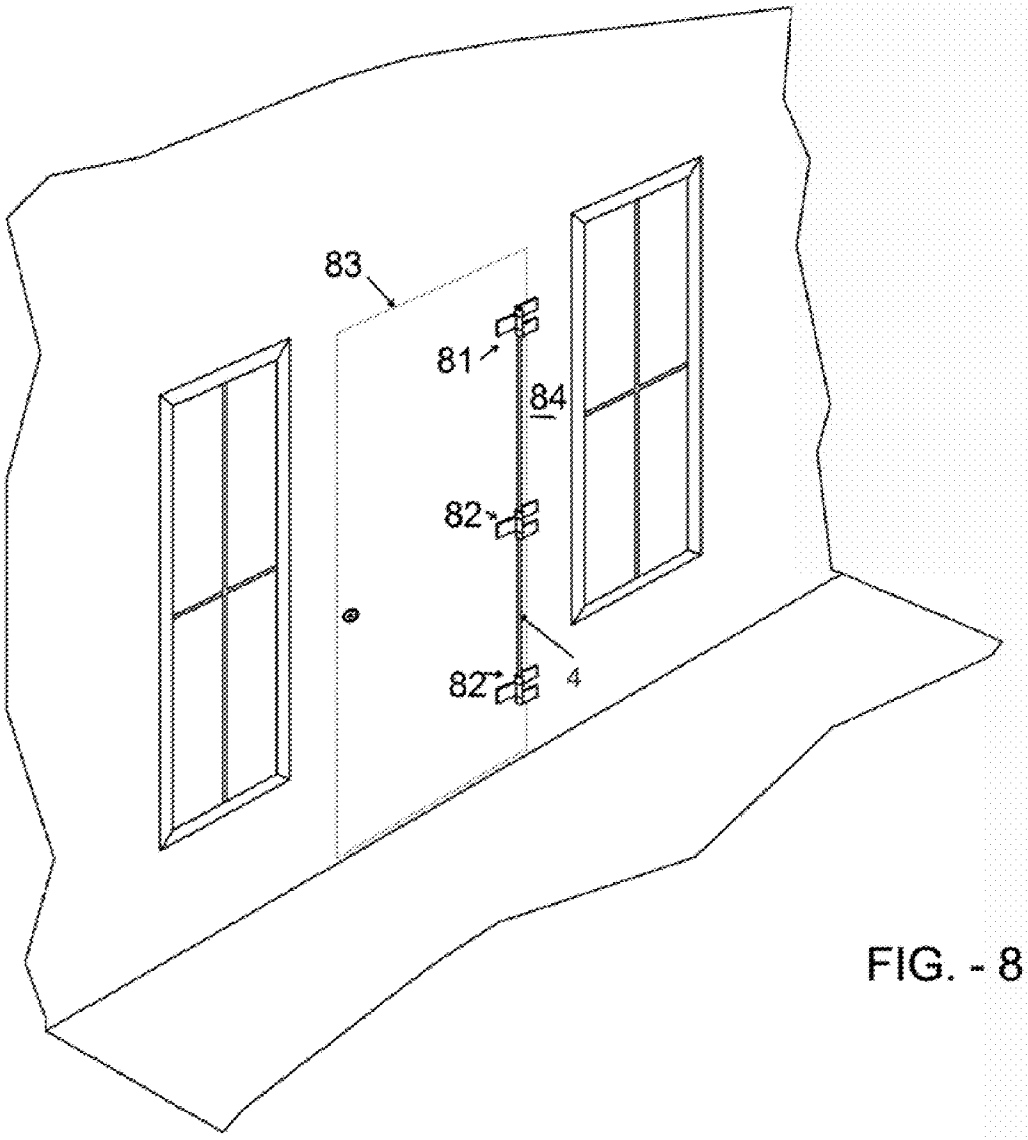
FIG. 8 is perspective view which depicts the external hinge assemblies of FIGS. 1-7 installed with a door

FIG. 8 is perspective view which depicts the external hinge assemblies of FIGS. 1-7 installed with a door. As shown the hinge assembly 81 and hinges 82 are attached both to the door 83 and the adjacent door frame 84 and the torsion bar 4 passes through the hinge assembly 81 and hinges 82 to function as the hinge pin about which the door 83 rotates between an open and closed position. If desired the torsion bar 4 could be concealed in a suitable housing.

Figure 9:
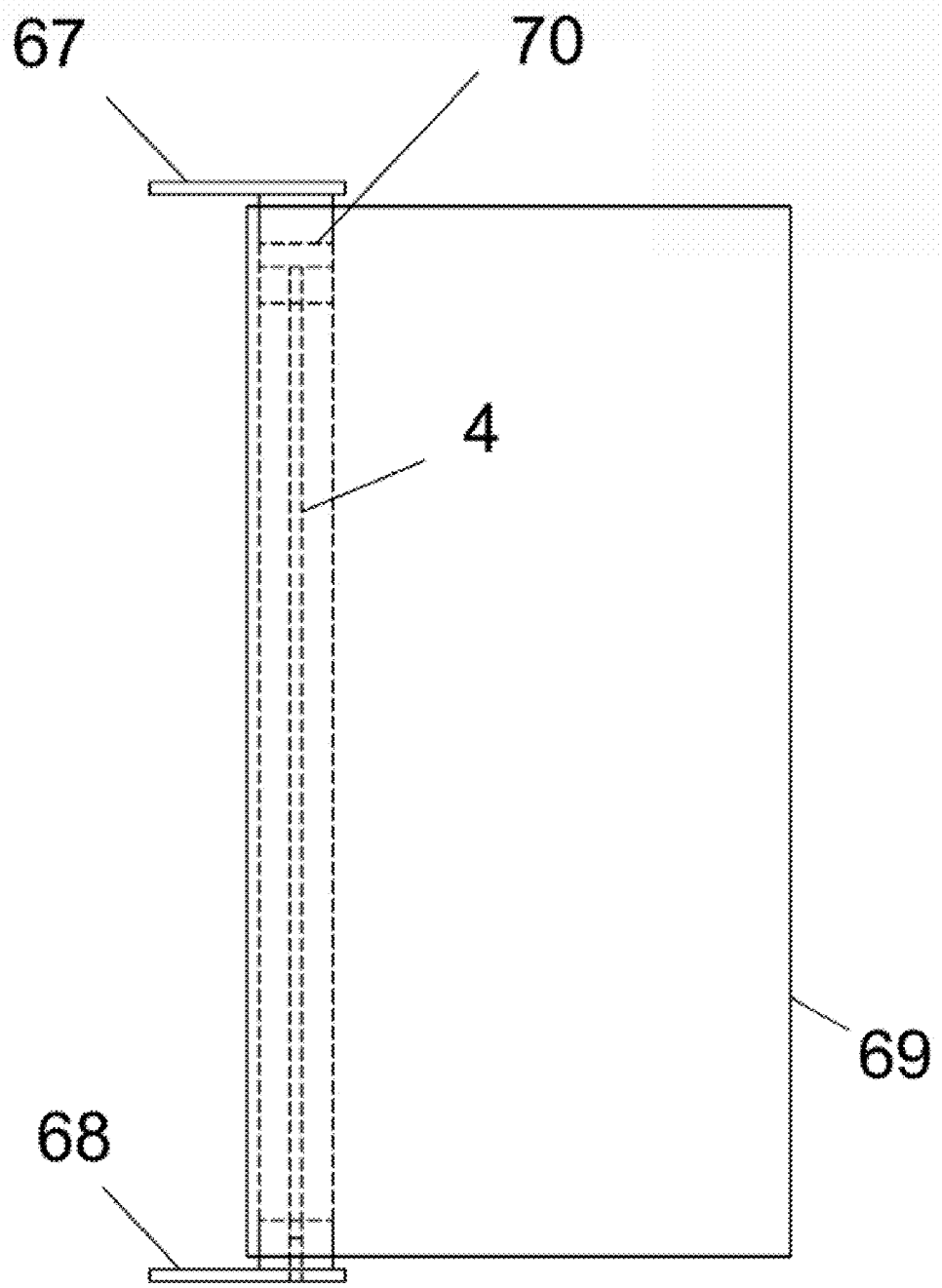
FIG. 9 is a planar view of an internal hinge assembly according to one embodiment of the present invention.

FIG. 9 is a planar view of an internal hinge assembly according to one embodiment of the present invention. As depicted in FIG. 9 the hinge assembly can be contained inside door. In FIG. 9 the torsion bar 4 extends between an upper hinge assembly 67 and a lower hinge 68. As in other embodiments one end of the torsion bar 4 is fixedly attached to the door 69 through the hinge assembly 67 and the other end of the torsion bar 4 is fixedly attached to the door frame (not shown) through the lower hinge 68.

In the embodiment depicted in FIG. 9 a force adjusting mechanism 70 similar to that discussed above in reference to FIGS. 1-3 or similar to that discussed above in reference to FIGS. 4 and 5 or in reference to FIGS. 6 and 7 is provided in the upper hinge assembly 67. If necessary the internal structure of the door 69 can be reinforced as needed to house and operate with the internal hinge assembly. In further embodiments the hinge assembly including the force adjusting mechanism can be concealed within a portion of the frame work adjacent a door.

It is to be understood that in an alternative embodiment similar to FIG. 9 the force adjusting mechanism 70 could be provided in the lower part of the door 69. A service access panel(s) can be provided as desired to access elements, of the force adjusting mechanism.

In further embodiments of the present invention the hinge assembly elements including the torsion bar could be built or contained in the doorframe adjacent the door with hinge brackets extending outward for attachment to the door.

The embodiments of the invention described above are depicted as having a single torsion bar that extends substantially the full height of the doors. As noted above in further embodiments shorter torsion bars may be used or more than one torsion bar could be used.

Figure 10:
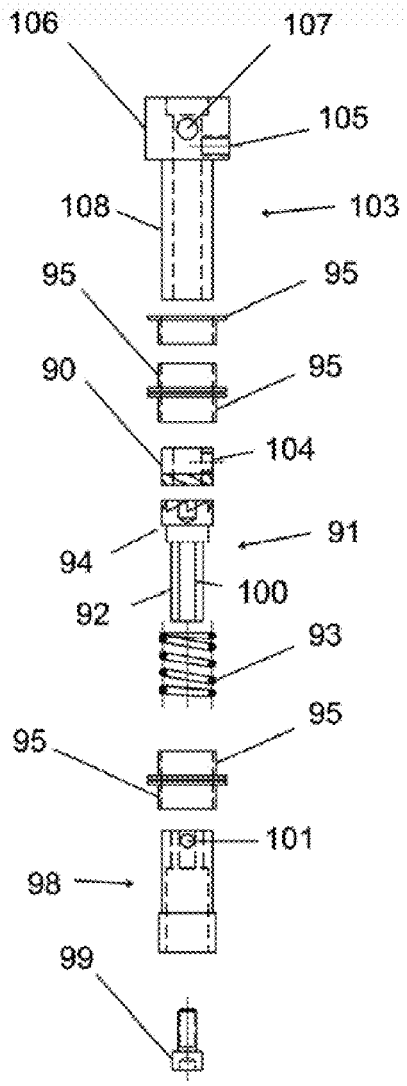
FIG. 10 is an exploded view of a torque pre-loading assembly.
Figure 11:
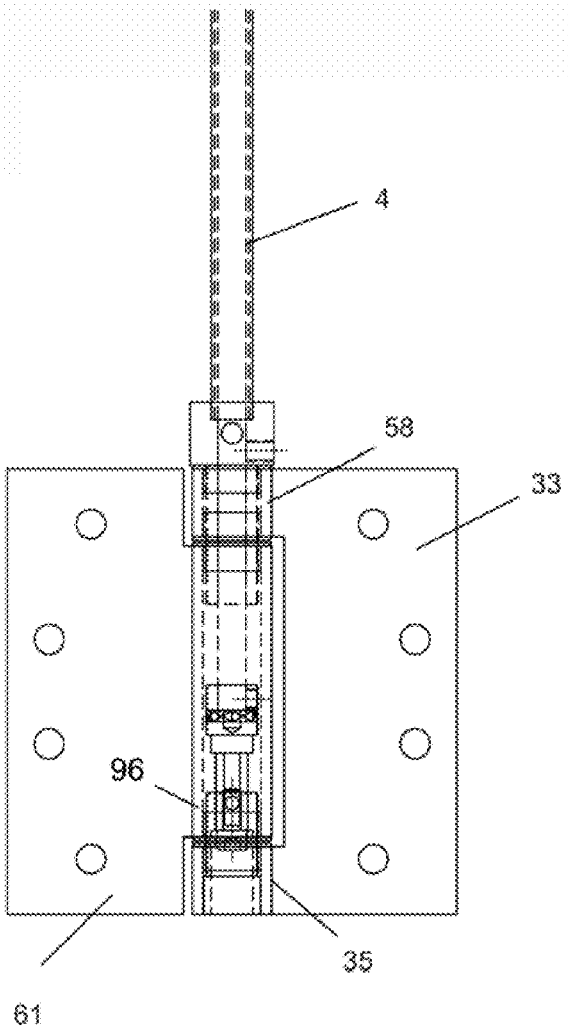
FIG. 11 is a planar view of the torque pre-loading assembly of FIG. 10 position in a hinge assembly.

FIG. 10 is an exploded view of a torque pre-loading assembly. FIG. 11 is a planar view of the torque pre-loading assembly of FIG. 10 position in a hinge assembly.

A torque pre-loading assembly is shown in FIGS. 10 and 11 which can be incorporated in the hinge assembly that fixes the end of the torsion bar in a fixed manner to a door to rotate and twist when a door is opened (e.g. lower hinge 1 in FIG. 1).

The torque pre-loading assembly includes a cooperating pair of one-way rotating gear elements including an upper gear element 90 and a lower gear element 91. The lower gear element 91 includes a downward depending shaft 92 about which coil spring 93 is provided. Coil spring 93 is held between a lower stepped portion 94 of the lower gear element 91 and the top of a lower adjustment element 98 that is received in a lower end of a bore 60' formed in the static hinge bracket 61 shown in FIG. 11. The coil spring 93 can be adjustable compressed by means of lower adjustment element 98 into which the downward depending shaft 92 of the lower gear element 91 is received. A threaded member 99 shown in FIG. 10 passes through the lower adjustment element 98 and is received in an internally threaded bore 100 provided in the downward depending shaft 92 so that tightening the threaded member 90 in bore 100 compresses coil spring 93 between the lower slapped portion 94 of the lower gear element 91 and lower adjustment element 98. Lower adjustment element 98 includes a pin bore 101 by which lower adjustment element 98 can be pinned to static hinge bracket 61 so as not to rotate therein.

Upper gear element 90 receives the lower end of torsion bar 4 (FIG. 11). Torsion bar 4 passes through upper adjustment element 103. Both the upper gear element 90 and upper adjustment element 103 have threaded bores 104 and 105 that receive set screws (not shown) to secure the upper gear element 90 and upper adjustment element 103 to the torsion bar 4. The upper adjustment element 103 can be rotated to thereby rotate torsion bar 4 to twist and pre-load the torsion bar 4. After rotating/twisting the torsion bar 4 incrementally as the teeth of the upper gear element 90 ride over the teeth of the lower gear element 91 (against coil spring 93), the teeth of upper gear element 90 and lower gear element engage to hold the torsion bar 4 in the adjusted twisted/pre-loaded position. In this manner torque can be preloaded in the torsion bar 4. In order to rotate upper adjustment element 103 the upper portion 106 of the upper adjustment element 103 can be provided with a plurality of radial bores 107 into which a pin or shaft can be inserted to rotate the upper adjustment element 103.

As shown in FIG. 11 the lower portion 108 of the upper adjustment element 103 extends in upper bore 58 of pivotal hinge bracket 33 and bore 60' formed in static hinge bracket 61. The lower adjustment element is received in lower bore 36 in pivotal hinge bracket 33 and bore 60' formed in static hinge bracket 61.

Figure 12:
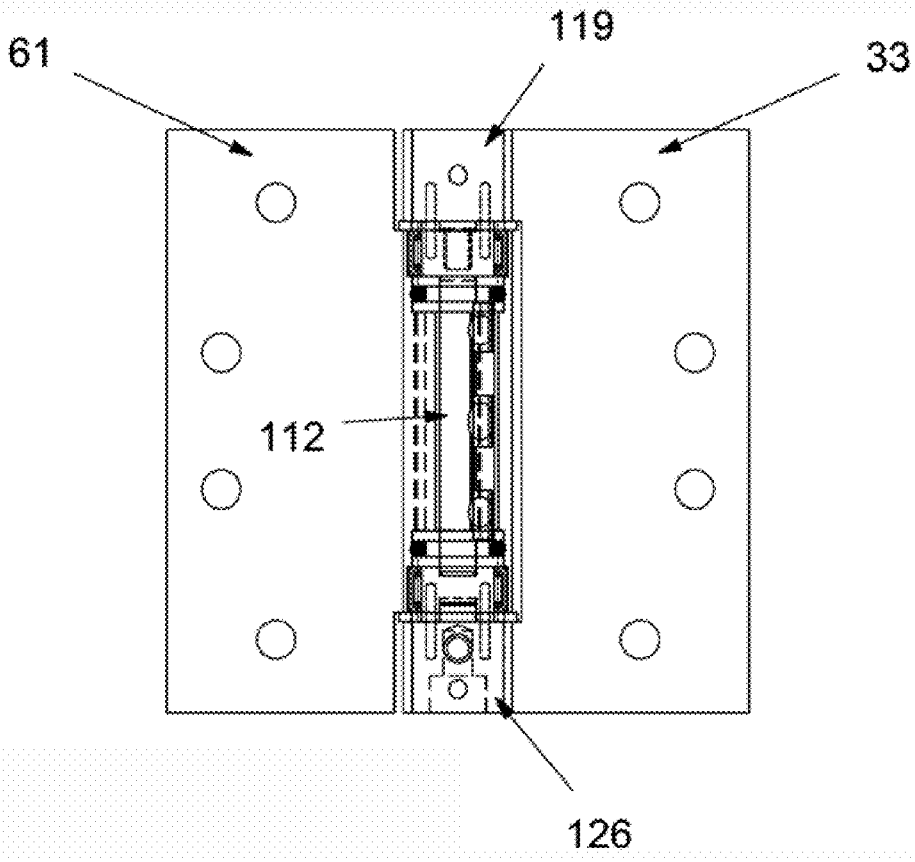
FIG. 12 is a side view of a force adjusting mechanism according to another embodiment of the present invention.
Figure 13:
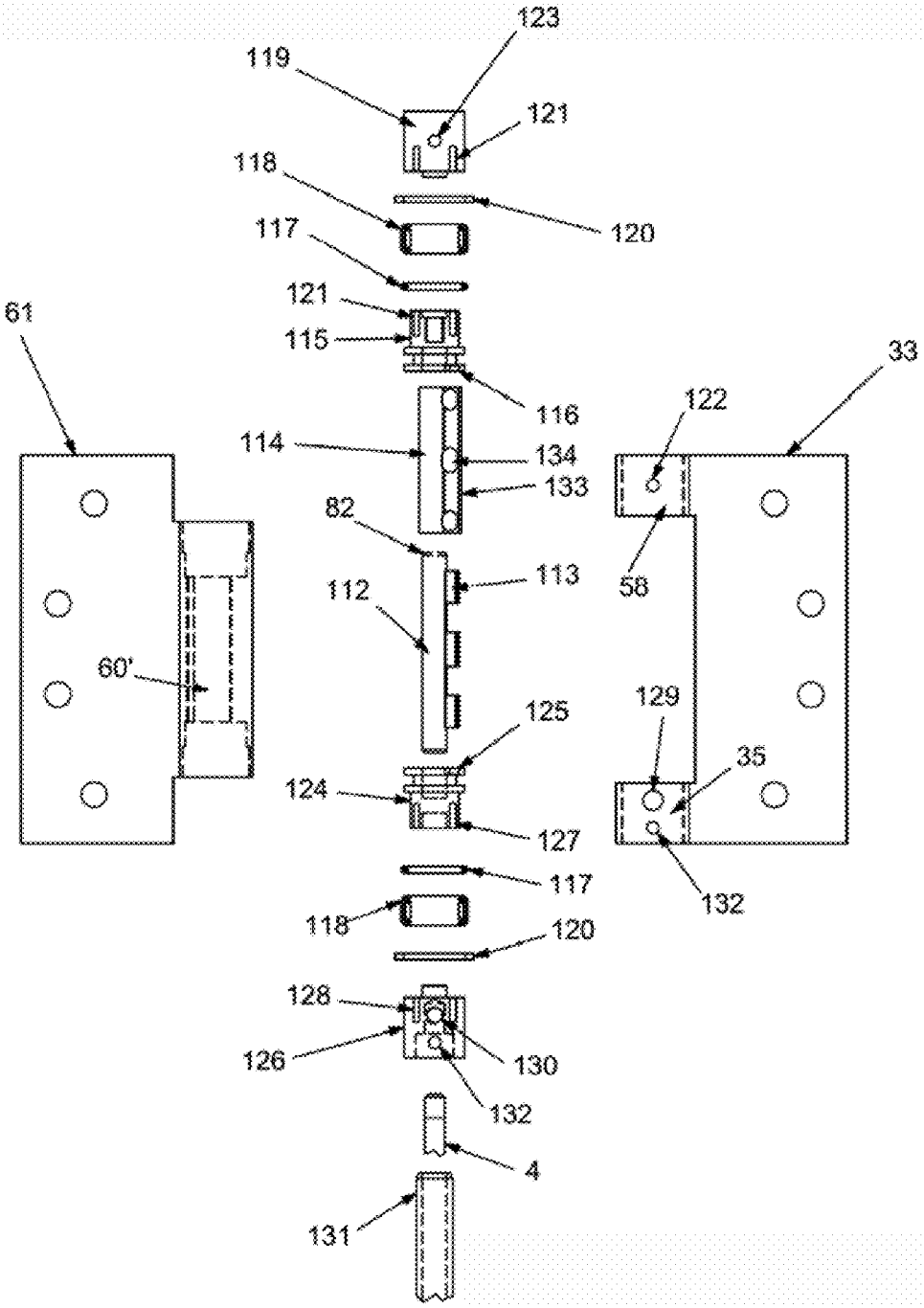
FIG. 13 is an exploded view of the force adjusting mechanism of FIG. 12.
Figure 15:
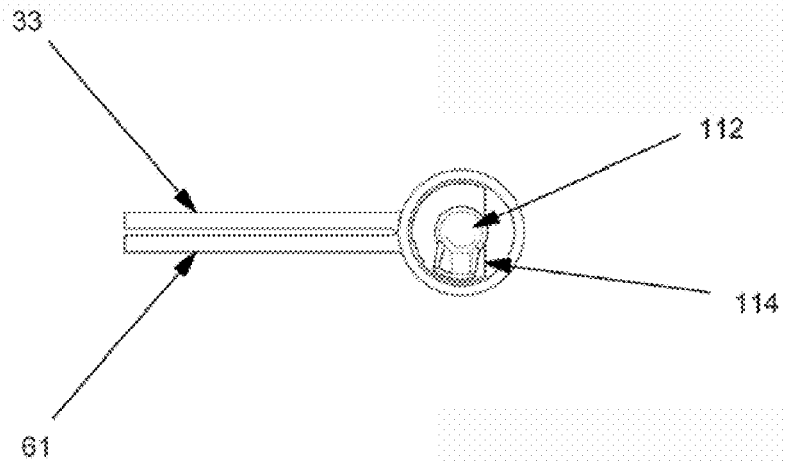
FIGS. 14 and 15 depict different positions of the wiper is the piston of FIGS. 12 and 13 is rotated.

FIG. 12 is a side view of a force adjusting mechanism according to another embodiment of the present invention. FIG. 13 is an exploded view of the force adjusting mechanism of FIG. 12.

The force adjusting mechanism in FIGS. 12 and 13 includes a pivot hinge bracket 33 that is attached to door (not shown) for pivotal movement therewith and a static hinge bracket 61 that is attached in a fixed manner to a structure adjacent the door such as a door frame.

A piston 112 is provided that includes a plurality of discrete radially extending portions 113. The upper end and lower end of the piston 112 are received in a fluid tight chamber provided in the bore 60' of the static hinge bracket 61 and the piston 112 is surrounding by a wiper 114 which will be described below.

The piston 112 is configured to be rotated with the pivotal hinge bracket 33. In this regard the ends of the piston 112 are received in bearing assemblies which fasten the ends of the piston 112 in bores 35 and 58 of the pivot hinge bracket 33 while allowing the piston 112 to rotate freely in the bore 60' of the static hinge bracket 61. In the embodiment shown in FIGS. 12 and 13 the upper bearing assembly includes a lower member 115 that includes a lower bore that receives a top portion of the piston 112 therein and a recess 116 that receives a top portion of the upper radially extending portion 113 therein. As shown in FIG. 13 the lower member 115 is received in a stepped portion of the top of bore 60' an o-ring 117 and a roller bearing 118 are provided over the lower member 115. These elements are all received in the stepped portion of the top of bore 60' and an upper member 119 is received in the upper bore 58 of the pivot hinge bracket 33 and a flat friction reducing bushing 120 is provided between the adjacent surfaces of the pivot and static hinge brackets 33 and 61 as shown in FIG. 13. Pins (not shown) are received in the opposing bores 121 in the upper and lower members 119 and 115. The upper member 119 is secured to the pivotal hinge bracket 33 by a pin or similar member that is received in bores 122 and 123.

The piston 112 is received in wiper 114 which will be described below.

The lower bearing assembly includes an upper member 124 that is similar to the lower member 115 of the upper bearing assembly. The upper member 124 of the lower bearing assembly includes an upper bore that receives a bottom portion of the piston 112 therein and a recess 125 that receives a bottom portion of the lower radially extending portion 113 therein. As shown in FIG. 13 the upper member 124 of the lower bearing assembly is received in a stepped portion of the bottom of bore 60' an o-ring 117 and a roller bearing 118 are provided over the upper member 124. These elements are all received in the stepped portion of the bottom of bore 60' and an lower member 126 of the lower bearing assembly is received in the bottom bore 35 of the pivot hinge bracket 33 and a flat friction reducing bushing 120 is provided between the adjacent surfaces of the pivot and static hinge brackets 33 and 61 as shown in FIG. 13. Pins (not shown) are received in the opposing bores 127 and 128 in the lower end upper members 124 and 126. The lower member 126 is secured to the pivotal hinge bracket 33 by a pin or similar member that is received in bores 132 and 132'. The lower member 126 includes a bottom bore into which the top end of a torsion bar 4 can be received an secured by a set screw together with a tubular member 131 through which the torsion bar 4 extends if desired. A port 129 is provided in the pivotal hinge bracket 33 that allows access to the set screw that fixes the torsion bar 4 to the lower member 126 in bore 130 for purposes of adjusting the force adjusting mechanism.

Figure 14:
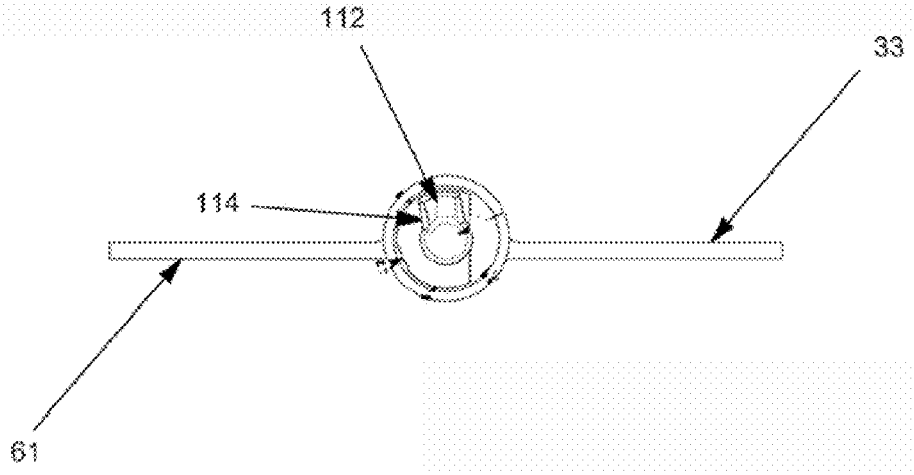

The wiper 114 is positioned about the piston 112 as shown in FIGS. 14 (3) and 15 (4). The wiper 114 is complementarily shaped to the piston 112 as shown and includes a radially projecting portion 133 having opposite radial faces. One of the radial faces of the projecting portion of the wiper include through holes 134 as shown in FIG. 12 that are equal in number and aligned with the radially projecting portions 113 of the piston 112. As can be understood when the piston rotates so that holes 134 are aligned with the radially projecting portions 113 of the piston 112 fluid with in the chamber of bore 60' is blocked from passing through these holes 134 so as to resist rotational movement of the piston 112.

The opposed radial face of the projecting portion of the wiper 114 includes through holes that are aligned between the radially extending portions 113 of the piston 112. When the piston is rotated in an opposite direction these through holes are not blocked by the projecting portions 113 of the piston 112 so that there is no resistance to rotational movement of the position.

As can be understood this configuration of the piston 112 and wiper 114 allows for no fluid resistance when the piston is rotated in one direction (i.e. when the door is opened) and provides fluid resistance when the door is rotated in the opposite direction (i.e. when the door closes) to control the closing force of the door.

Figure 16:
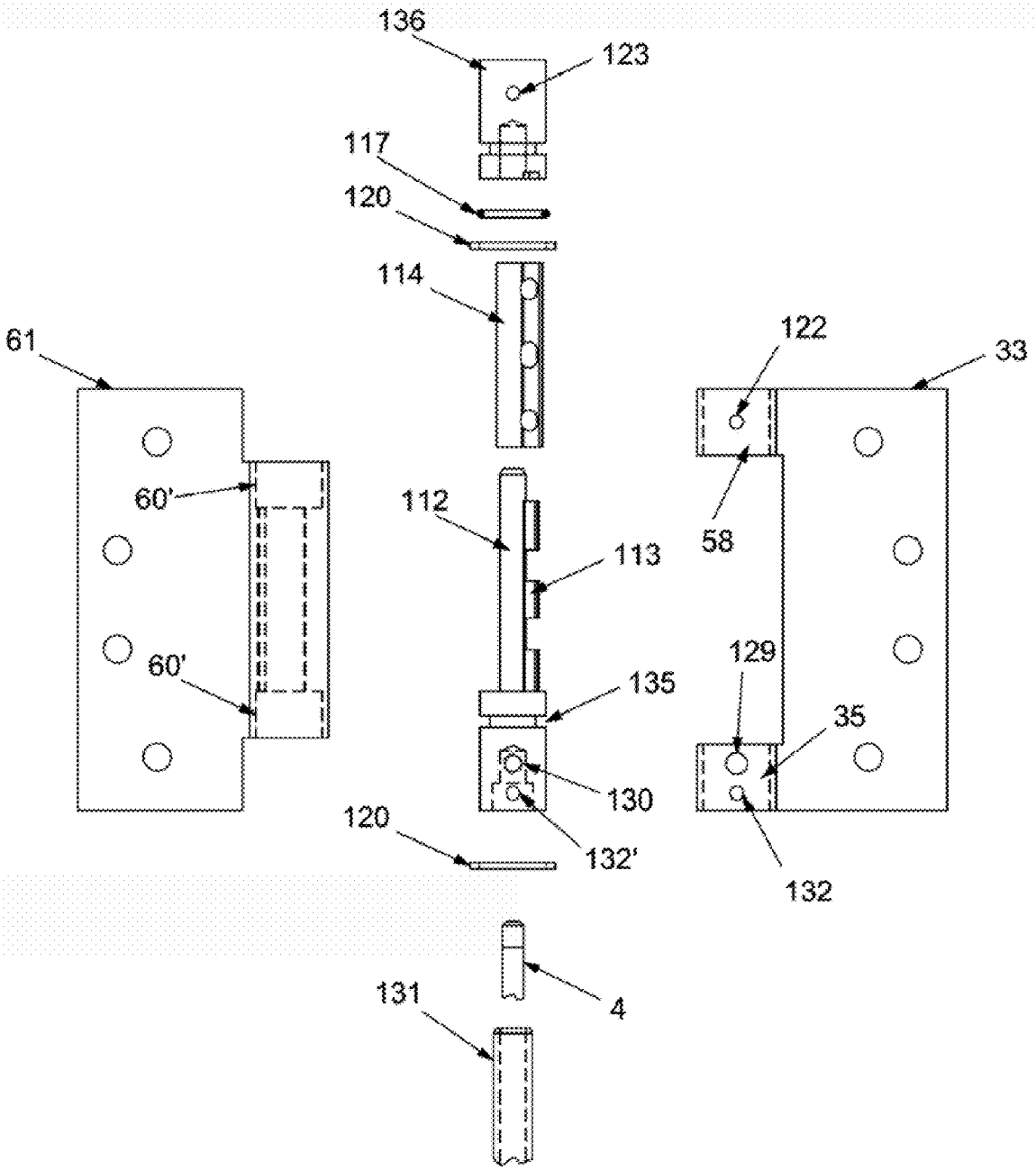
FIG. 16 is an exploded view of a force adjusting mechanism according to another embodiment of the present inversion that is similar to FIGS. 12-16 but does not include the roller bearings.

FIG. 16 is an exploded view of a force adjusting mechanism according to another embodiment of the present invention that is similar to FIGS. 12-15 but does not include the roller bearings.

In the embodiment shown in FIG. 16 the lower portion of the piston 112 is provide with an integral member 135 that is received in the lower bore 35 and bore 60' of each of the pivotal end static hinge brackets 33 and 61 and an upper member 138 is received in the upper bores 58 and 60' of each of the pivotal and static hinge brackets 33 and 61. All other elements are substantially the same as the embodiment shown in FIGS. 12-15.

Figure 17:
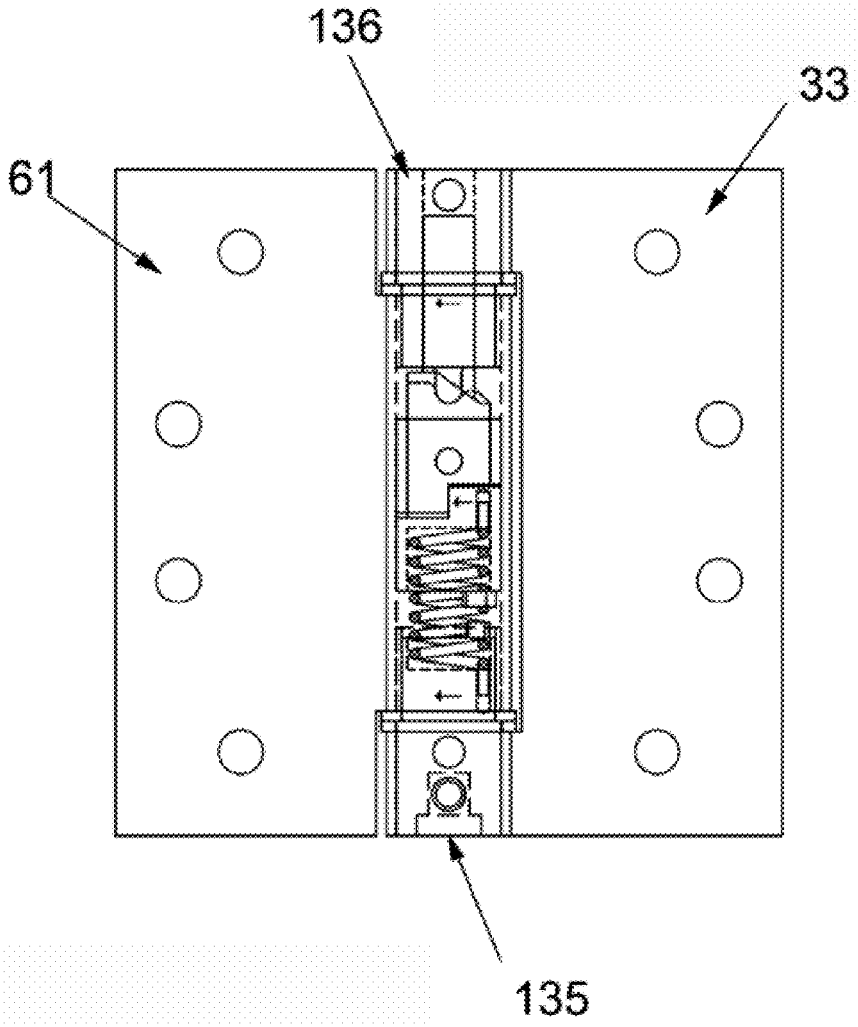
FIG. 17 is a side view of a force adjusting mechanism according to another embodiment of the present invention.
Figure 18:
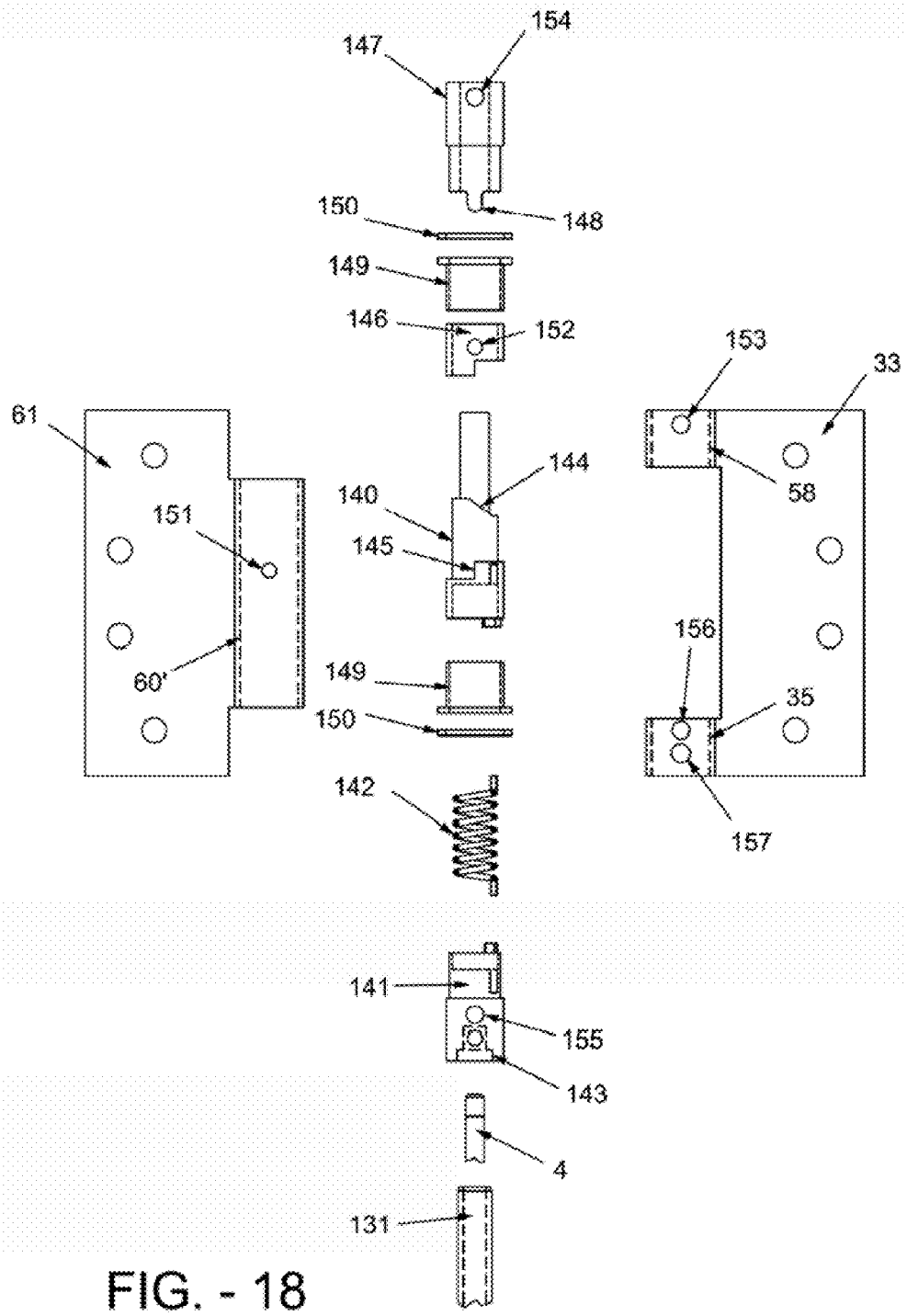
FIG. 18 is an exploded view of the force adjusting mechanism of FIG. 17.

FIG. 17 is a side view of a force adjusting mechanism according to another embodiment of the present invention. FIG. 18 is an exploded view of the force adjusting mechanism of FIG. 17.

The force adjusting mechanism in FIGS. 17 and 18 includes a pivot hinge bracket 33 that is attached to door (not shown) for pivotal movement therewith and a static hinge bracket 61 that is attached in a fixed manner to a structure adjacent the door such as a door frame.

An upper spring coupler 140 and a lower spring coupler 141 receive a spring 142 therebetween as depicted. The lower spring coupler 141 includes a stepped bore 143 that receives and end of torsion bar 4 and an optional tubular cover 131 for the torsion bar 4.

The upper spring coupler 140 includes a upper inclined surface 144 that is above a stepped surface 145. A stepped collar 146 is received over upper spring coupler 140 and is configured to engage the stepped surface 145 of the upper spring coupler 140 as discussed below. An upper member 147 is received over the upper spring coupler 140 and includes a cam projection 148 that rides along the inclined surface 144 as discussed below.

The upper spring coupler 140 and stepped collar 146 are receive in bore 60' of the static hinge bracket 61 with caps 149 and bushings 150 between the static hinge bracket 61 and pivot hinge bracket 33 as shown. The stepped collar 146 is fixed in bore 60' by a pin or other mechanical fastener (not shown) that is received in bores 151 and 152. The upper member 147 is received in upper bore 58 of the pivot hinge bracket 33 and fixed therein by a pin or other mechanical fastener (not shown) that is received in bores 153 and 154. The lower spring coupler 141 is received in lower bore 35 of the pivot hinge bracket 33 and fixed therein by a pin or other mechanical fastener (not shown) that is received in bores 155 and 156. Bore 157 is used to access a set screw (not shown) that secures torsion bar 4 in the lower spring coupler 141.

As pivot hinge bracket 33 rotates both the lower spring coupler 141 and upper member 147 rotate while the stepped collar 146 remains fixed to the static binge bracket 61.

As can be appreciated torsion force that on torsion bar 4 that is developed between the static hinge bracket 61 and pivot hinge bracket 33 is transferred through spring 142, upper spring coupler 140 and stepped collar 146.

The upper member 147 and lower spring coupler 141 do not rotate relative to one another since they are both fixed with respect to the pivotal hinge bracket 33. The stepped collar 146 engages the stepped surface 146 of the upper spring coupler 140 so that as the lower spring coupler 141 rotates with pivot hinge bracket 33 torsion force develops in spring 142. As the upper member 147 rotates with the pivot hinge bracket 33 the cam projection 148 slides up inclined surface 144 pushing down on the upper spring coupler 140 until the stepped collar 146 disengages the stepped surface 145 of the upper spring coupler 140.

From the description above it can be appreciated that in the embodiment of the invention shown in FIGS. 17 and 18 torsion forces can be built up both in the torsion bar 4 and in spring 142 and released from spring 142 by disengaging stepper collar 146 from the stepped surface 145 of the upper spring coupler 140. This allows controlled release of the tension force so as to control the closing of the door.

Figure 19:
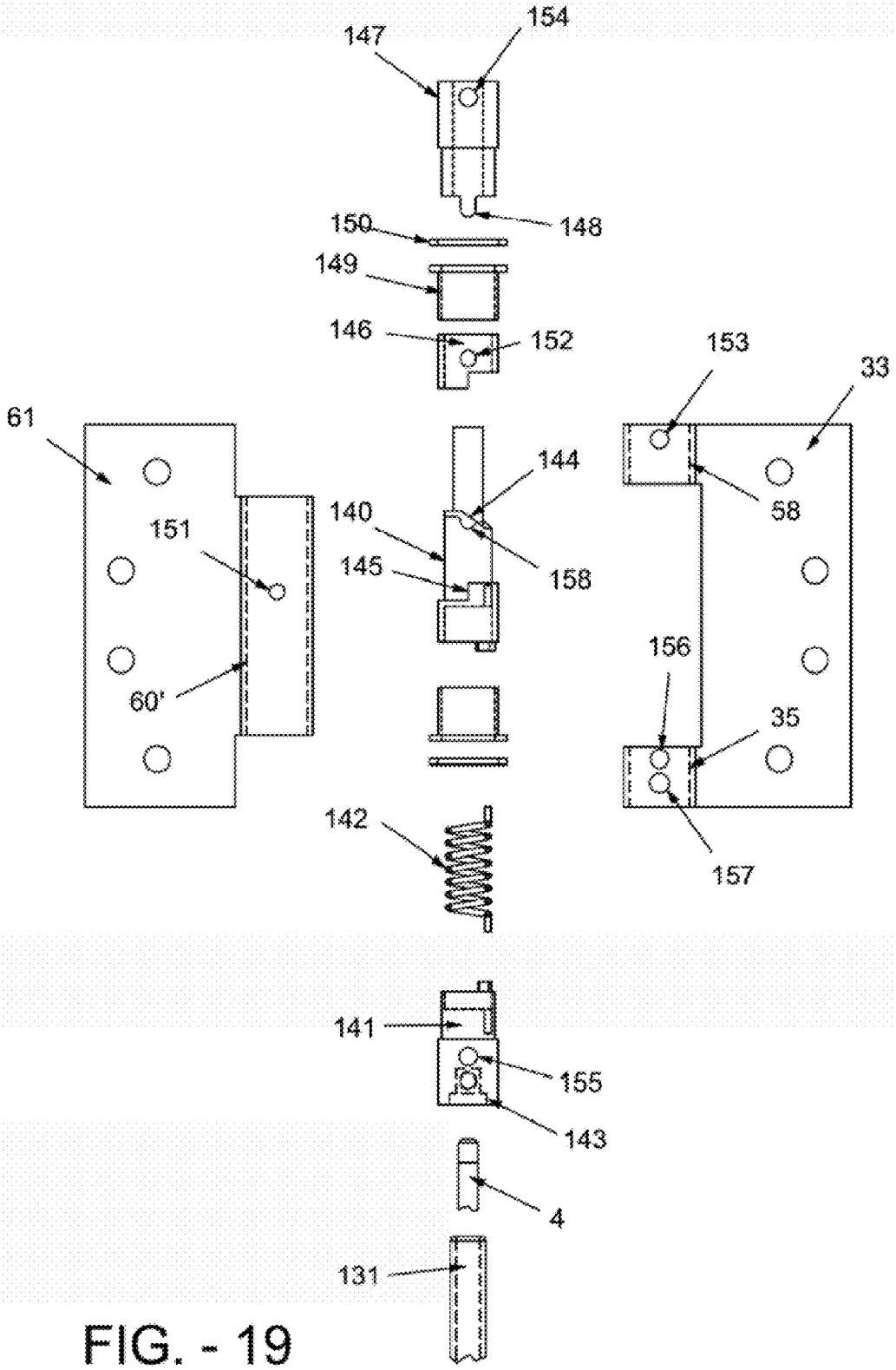
FIG. 19 is an exploded view of a force adjusting mechanism similar to that of FIGS. 17 and 18.

FIG. 19 is an exploded view of a force adjusting mechanism similar to that of FIGS. 17 and 18. In the embodiment of FIG. 19 a detent 158 is provided behind the inclined surface 144 of the upper spring coupler that will hold a door in an open position until the door is pushed to disengage the cam projection 148 from the detent 18.

Figure 20:
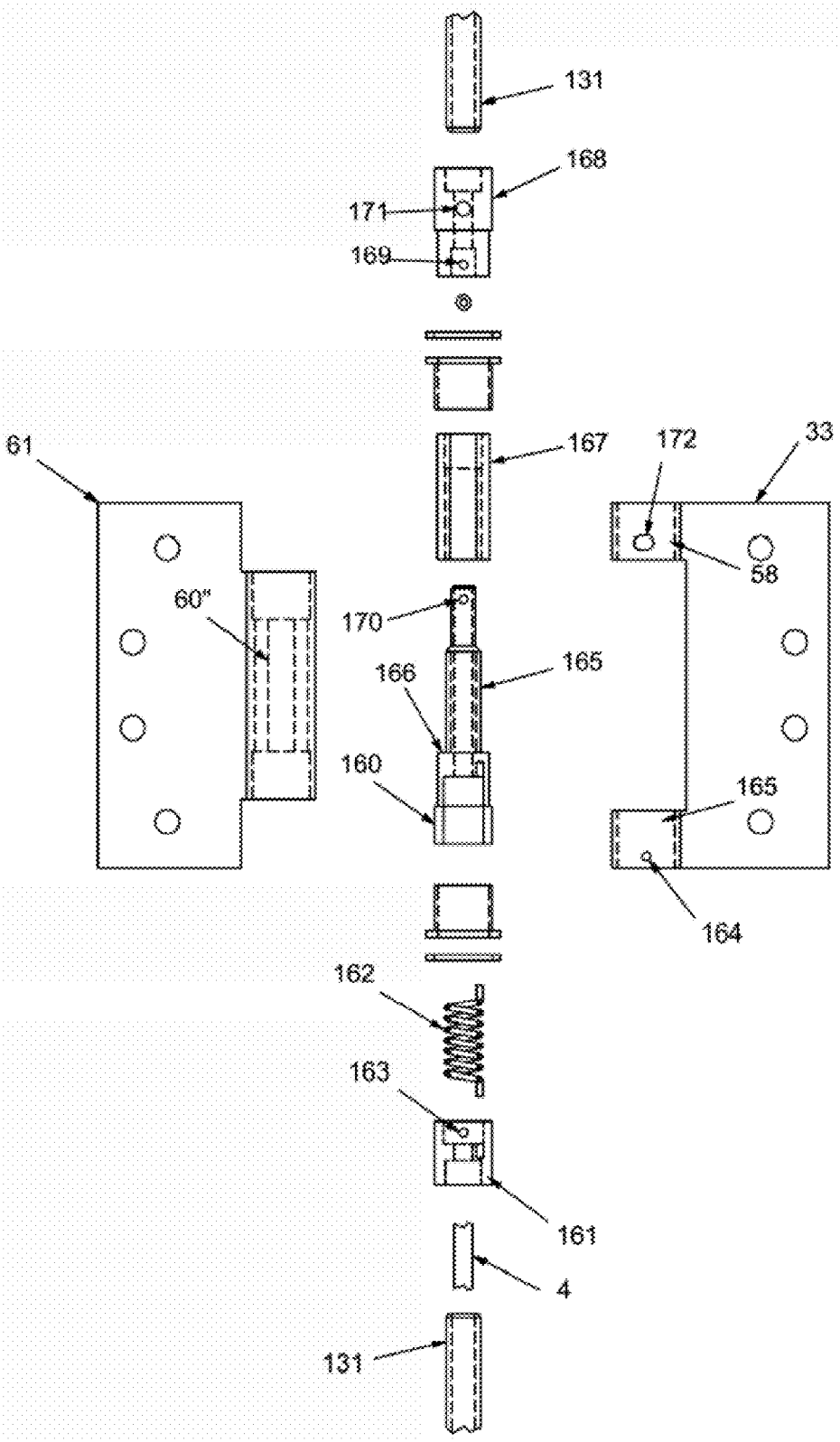
FIG. 20 is an exploded view of a mechanism that will hold a door open according to one embodiment of the present invention.
Figure 21:
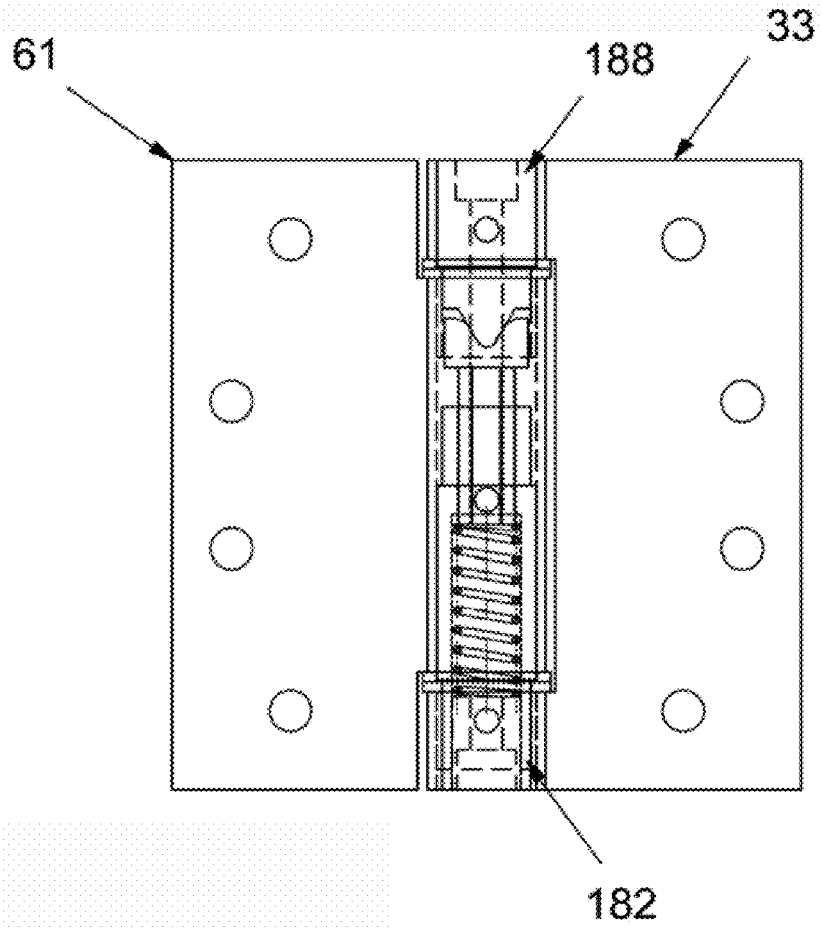
FIG. 21 is a side view of a mechanism that will hold a door open according to another embodiment of the present invention.
Figure 22:
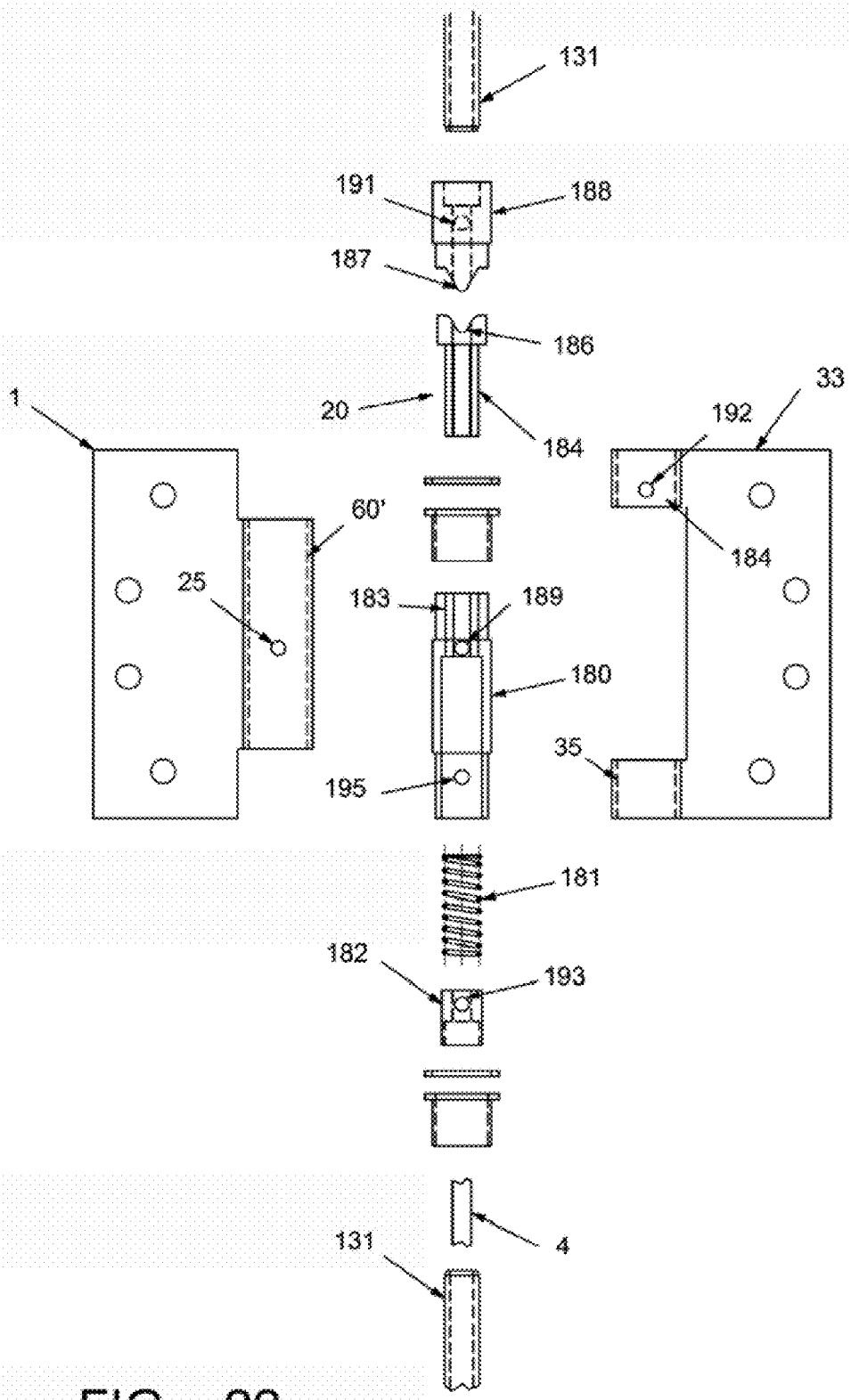
FIG. 22 is an exploded view of the mechanism of FIG. 21.

FIG. 20 is an exploded view of a mechanism that will hold a door open according to one embodiment of the present invention. FIG. 21 is a side view of a mechanism that will hold a door open according to another embodiment of the present invention. FIG. 22 is an exploded view of the mechanism of FIG. 21.

The door holding mechanisms of FIGS. 20-22 are assembled with respect to a middle hinge and each a torsion bar that extends therethrough.

The embodiment shown in FIG. 20 includes a upper spring coupler 160 and a lower spring coupler 161 which receive a spring 162 therebetween. The lower spring coupler 160 is received in the lower bore 35 of pivot hinge bracket 33 and fixed therein by a pin or other mechanical fastener (not shown) that passes through bores 163 and 164. The upper spring coupler 160 includes an exteriorly threaded portion 165 that extends above a stepped portion 166. An internally threaded hex shaped nut 167 is threaded onto exteriorly threaded portion 165 of the upper spring coupler 160 and received in a complementarily hex shaped bore 60" in static hinge bracket 61. An upper member 168 receives the top of the upper spring coupler 160 and a pin or mechanical fastener (not shown) is received in bores 169 and 179. The upper member 168 is received in upper bore 58 of the pivot hinge bracket 33 and fixed therein by a pin or mechanical fastener (not shown) that is received in bore 171 and oblong shaped bore 172.

When the door attached to the pivot hinge bracket 33 is opened hex nut 167 tightens on the exteriorly threaded portion 165 of the upper spring coupler 160 and bottoms out against stepped portion 166 thereby arresting rotational motion between the pivot hinge bracket 33 and the static hinge bracket 61 until one pushes the door closed to release the hex nut 167.

In FIG. 20 the spring 162 is provided to prevent the bottom of the hex nut 167 from tightening too much against stepped portion 166.

The torsion bar 4 passes through the assembly shown in FIG. 20 and is received in tube covers 131 on each side.

The mechanism that holds a door open in FIGS. 21 and 22 includes a spring loaded engaging assembly. The spring loaded engaging assembly includes a spring receiver 180 into which a spring 181 is received and contained by plug 182 that is pinned through bores 193 and 195. The top of the spring receiver 180 include a hex-shaped bore 183 into which is received the hex-shaped bottom 184 of a piston 185. The top of piston 185 includes a recess 186 that is configured to receive a complementarily shaped projection 187 provided on an upper plug 188.

The spring receiver 180 is fixed in bore 60' in static hinge bracket 61 by a pin or other mechanical fastener (not shown) that extends through bores 189 and 190. The upper plug 188 is fixed in upper bore 58 of the pivot hinge bracket 33 by a pin or other mechanical fastener (not shown) that extends through bores 191 and 192.

As can be understood from FIG. 22 when the projection 187 of the upper plug 188 engages in the recess 186 of the piston 185 the door can be held open. Then by rotating the door and causing the piston 185 to push downward against spring 181 the engagement between the projection 187 of the upper plug 188 engages in the recess 186 of the piston 185 can be overcome and the door can close.

The torsion bar 4 passes through the assembly shown in FIG. 20 and is received in tube covers 131 on each side.

Figure 23:
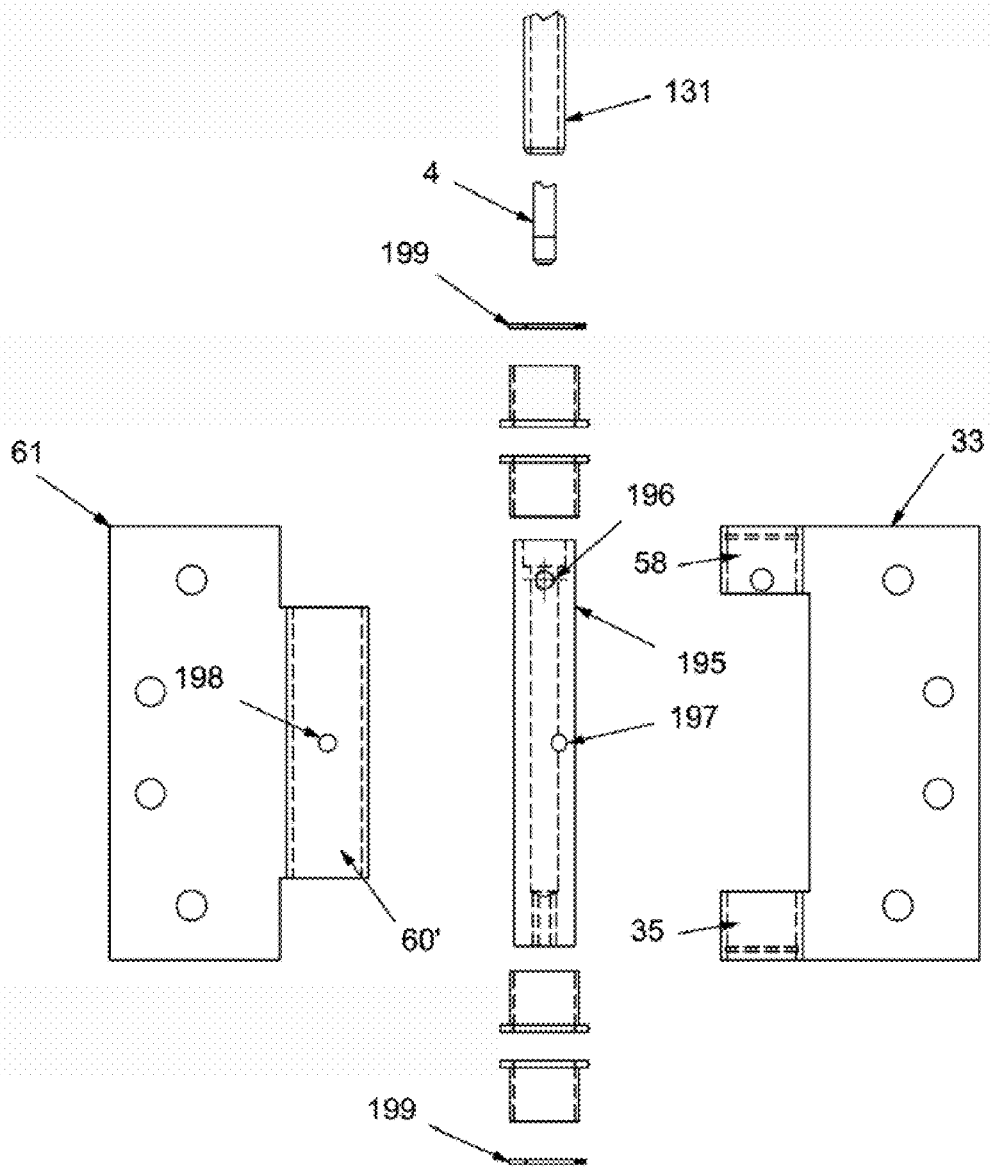
FIG. 23 is an exploded view of a torsion pre-set adjusting mechanism.

FIG. 23 is an exploded view of a torsion pre-set adjusting mechanism. The mechanism in FIG. 23 includes a tubular torsion force adjusting member 195 that receives torsion bar 4 in one end thereof and secures torsion bar 4 by a set screw (not shown) that is received in bore 196. The bottom of member 195 includes a hex-shaped bore that is configured to receive an allen wrench (or other tool) therein to rotate member 195 within bore 60' of static hinge bracket 61. Near the center of member 195 are a plurality of bores 197 that can selectively be aligned with bore 198 in the static hinge bracket 61 to be fixed by a pin or other mechanical fastener.

In use one adjusts or pre-sets tension in the tension bar by rotating member 195 (using an allen wrench or other too in the bottom) until a desired bore 197 is aligned with bore 198 and then inserts a pin or other mechanical fastener. Elements 199 in FIG. 23 are c-clips that are received in the upper and lower bores 58 and 35 of pivot hinge bracket 33.

Figure 24:
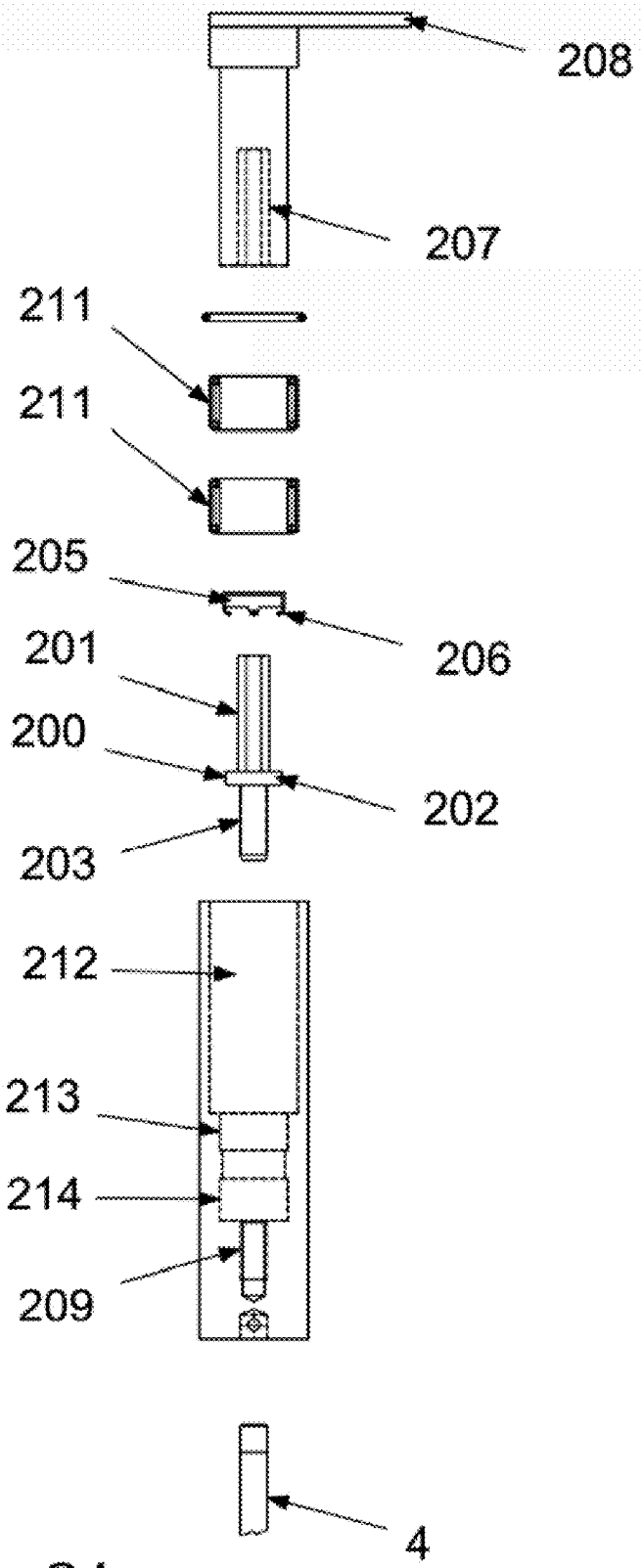
FIG. 24 is an exploded view of an in the door closing force adjusting mechanism according to another embodiment of the present invention.

FIG. 24 is an exploded view of an in the door closing force adjusting mechanism according to another embodiment of the present invention. The mechanism shown includes a piston 200 that has a hex-shaped upper portion 201, a disk-shaped flange 202 and an threaded lower portion 203. The piston 200 is received in a piston chamber 204 that is fixed inside a door. A wiper 205 is received over the upper portion 201 of the piston and is provided with lower depending clips 206 that secure the wiper 205 to the flange 202 in a manner that allows the wiper 205 to move slightly upward from the top of the flange 202 as described below.

The hex-shaped upper portion 201 of piston 200 is received in a complementarily shaped bore 207 of an upper hinge bracket 208 that is fixed to a structure adjacent to the top of the door (not shown).

The piston chamber 204 includes a threaded lower bore 209 that receives the threaded lower portion 203 of piston 200, and a chamber area through which the flange 202 of piston 200 passes together with wiper 205. The upper part of piston chamber includes a bore for receiving roller bearings 211.

In operation as the door moves between an open and closed position the piston 200 moves up and down in the piston chamber due to the threaded connection between the threaded lower bore 209 and threaded lower portion 203 of piston 200.

The flange 202 is provided with one or more through holes that extend therethrough. Likewise the wiper 205 includes one or mere through holes which are not aligned with the through holes in the flange 202. As a result when the piston 200 moves downward the wiper 205 lifts up (by the height of the clips 206) and fluid within the piston chamber is able to flow through the through holes in the wiper 205 and flange 202. In contrast when the piston moves up the wiper 205 seals the through hole in flange 202 thus restricting fluid flow through the flange 202. The area in the piston chamber where the flange 202 moves up and down is shown as having three different diameters 212, 213 and 214 (more or less are possible). As can be understood the different diameters allow for a varying radial gap between the outer edge of wiper 205 and the inner walls of these areas. Thus the inner shape of the diameter of the area of the piston chamber in which the flange 202 and wiper 205 moves can be designed to release fluid pressure in a controlled manner to close the door with varying degrees of force throughout rotation from being fully opened to closed.

In FIG. 24 the torsion bar 4 is received and fixed in the bottom of the piston chamber 204 as shown.

Figure 25:
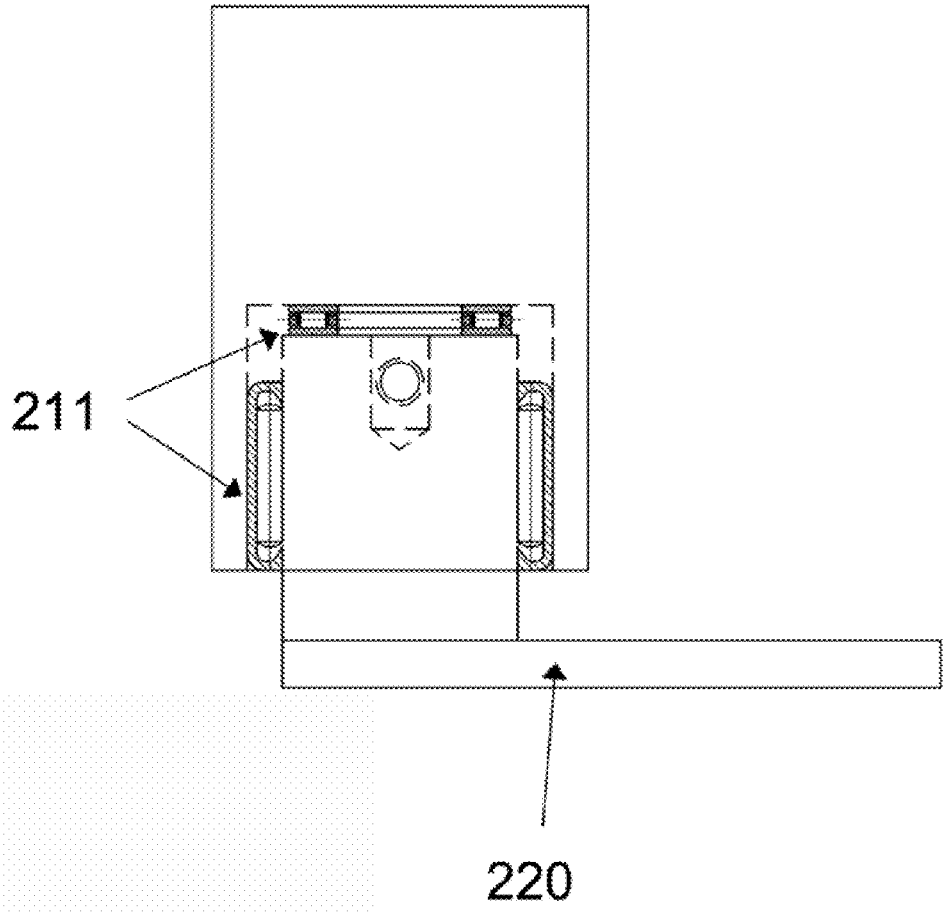
FIG. 25 is a side view of a hinge bracket that can be used in the other end of the door for the mechanism of FIG. 24.

FIG. 25 is a side view of a hinge bracket that can be used in the other end of the door for the mechanism of FIG. 24. In this case the bracket 220 is attached to a structure adjacent to the bottom of the door and a roller bearing configuration 221 (two bearings shown) provides rotational movement between the bracket 220 and door. In one or more embodiment an insert can be fixed within the door which receives the roller bearings and hinge bracket 220 and an end of a torsion bar 4 on an opposite end. An end of a torsion bar (not shown) can be received and fixed to bracket 220 via a bore and set screw arrangement.

FIG. 20 is an exploded view of a force adjusting mechanism that is similar to that shown in FIGS. 12 and 13 but which is configured to be installed in a door. Similar elements in FIGS. 12, 13 and 26 have similar reference numbers and the description of FIG. 26 will proceed with those elements that are different.

Figure 26:
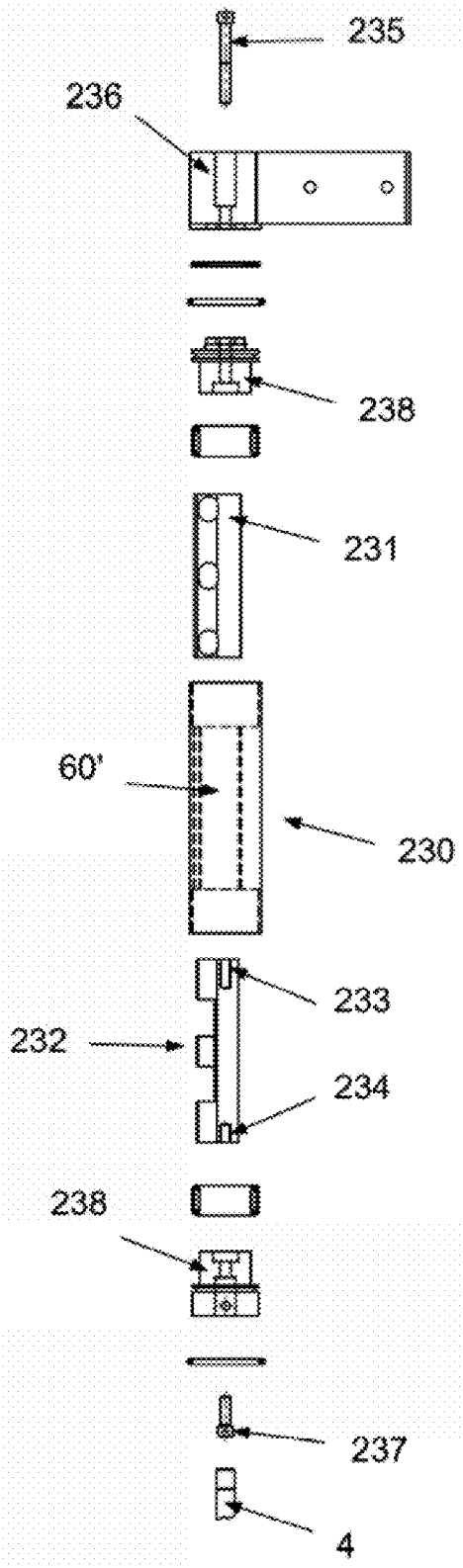
FIG. 26 is an exploded view of a force adjusting mechanism that is similar to that shown in FIGS. 12 and 13 but which is configured to be installed in a door.

In place of the static hinge bracket 61 shown in FIGS. 12 and 13 the assembly of FIG. 26 includes a block 230, fixed in the door that includes a bore 60' that is similar to the bore 60' in static hinge bracket 61 in FIGS. 12 and 13. The wiper 231 in FIG. 26 is substantially the same as the wiper in FIGS. 12 and 13. The piston 232 is similar to the piston in FIGS. 12 and 13 but has thread bores 233 and 234. Threaded bore 233 receives a threaded fastener 235 which is used to secure the piston 232 to hinge bracket 236 that is mounted to a structure adjacent the door. Threaded bore 234 receives a threaded fastener 237 that is used to secure lower plug 238 to the bottom of piston 232. In an alternative embodiment hinge bracket 236 mounted to the door and block 230 can be mounted to a structure adjacent the door.

With the piston 232 secured to the hinge bracket 236 and torsion bar 4 and the block 230 secured inside the door. The piston 232 and wiper 231 will cooperate to control the closing force of the door in the same manner as described in reference to FIGS. 12 and 13. Elements 238 are plugs that seal bore 60'.

Figure 27:
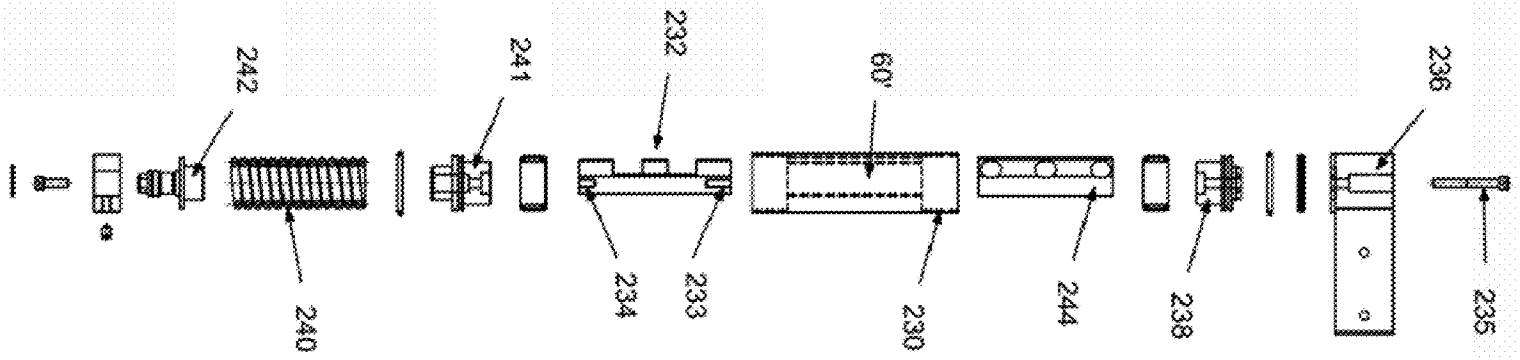
FIG. 27 is an exploded view of a force adjusting mechanism that is similar to that shown in FIG. 26 but which includes a torsion spring rather than a torsion bar

FIG. 27 is an exploded view of a force adjusting mechanism that is similar to that shown in FIG. 26 but which includes a torsion spring rather than a torsion bar. Similar elements in FIGS. 26 and 27 have similar reference numbers and the description of FIG. 27 will proceed with those elements that are different.

In place of the torsion bar 4 in FIG. 26 the embodiment of the invention shown in FIG. 27 includes a torsion spring 240 having ends that are secured against rotational movement in elements 241 and 242, with element 241 secured to piston 232 and element 242 secured to structure within the door. The piston 232 and wiper 244 will cooperate to control the closing force of the door built up in the torsion spring 240 in the same manner as described in reference to FIG. 26 in which force is built up in the torsion bar 4.

Figure 28:
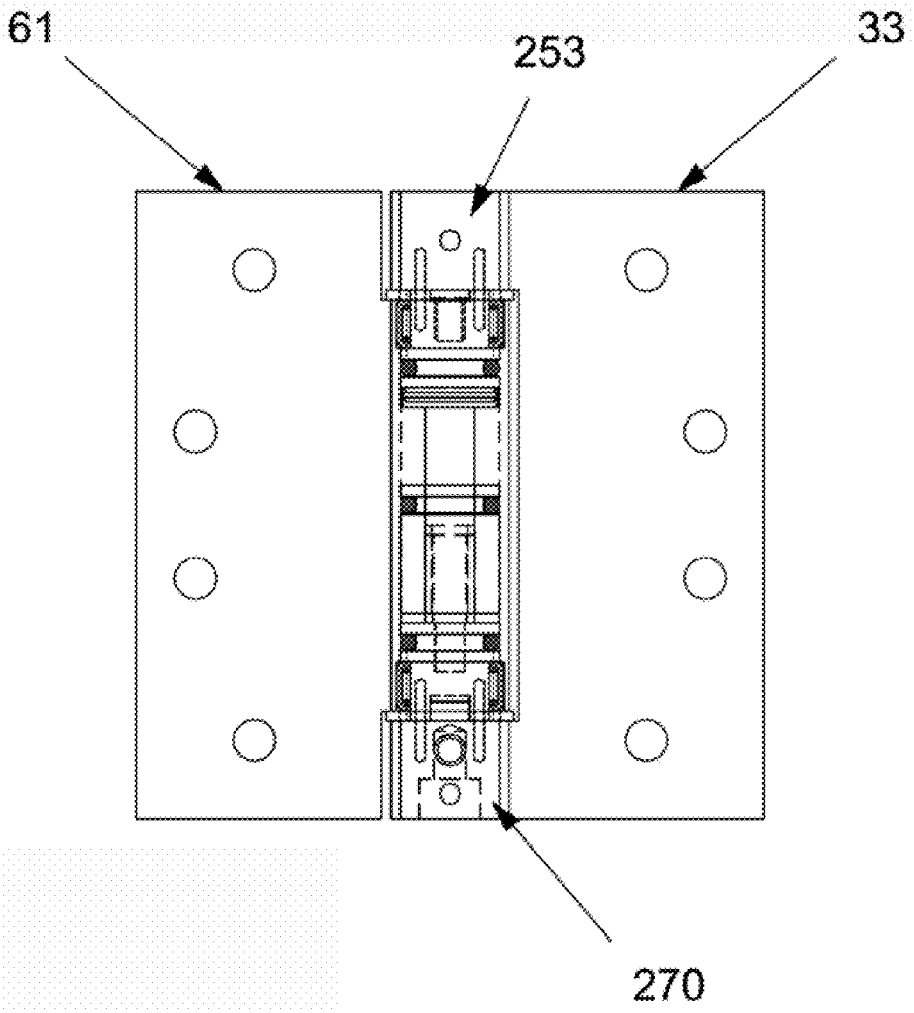
FIG. 28 is a side view of a force adjusting mechanism according to another embodiment of the present invention
Figure 29:
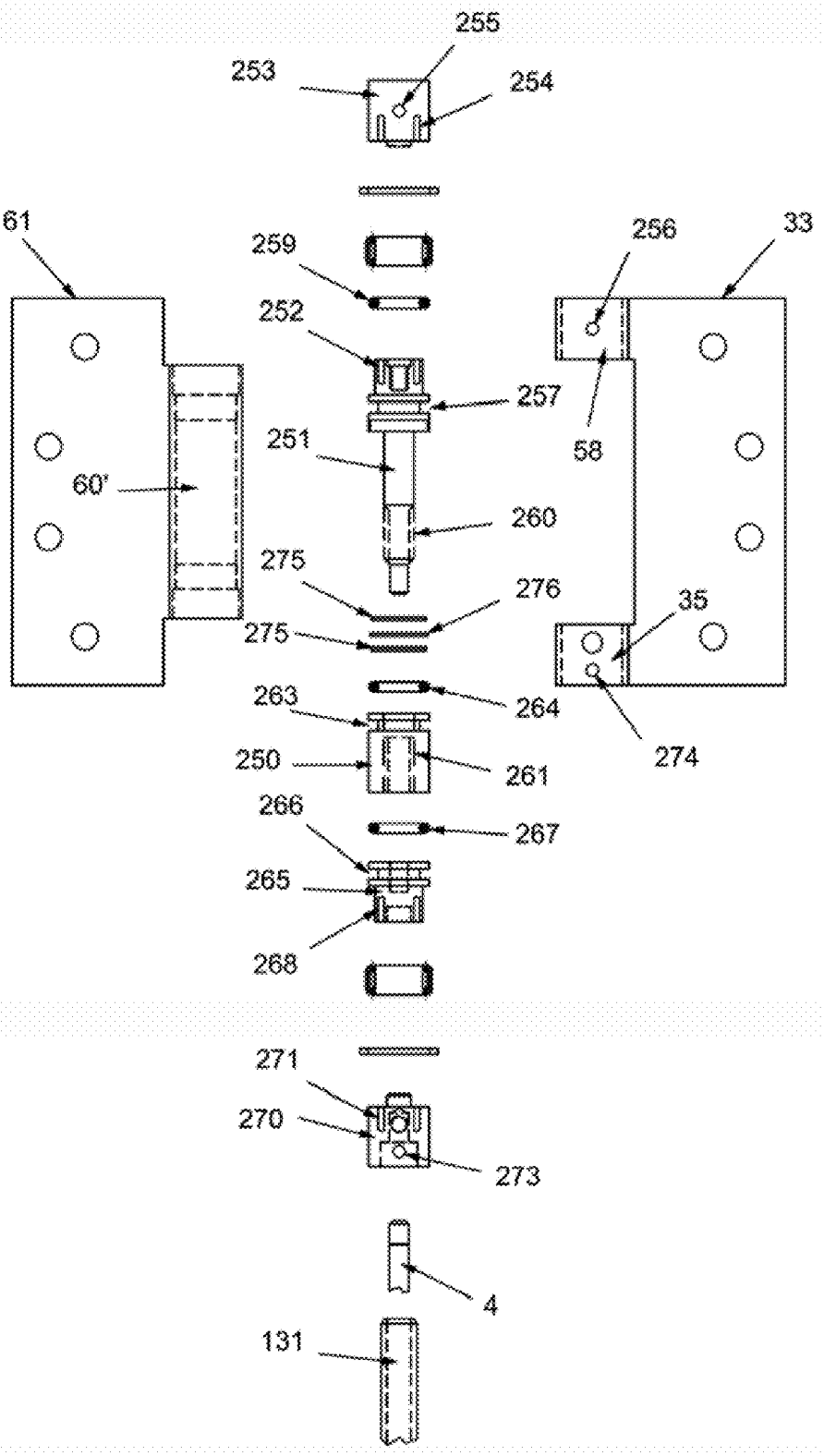
FIG. 29 is an exploded view of the force adjusting mechanism of FIG. 28.

FIG. 28 is a side view of a force adjusting mechanism according to another embodiment of the present invention. FIG. 29 is an exploded view of the force adjusting mechanism of FIG. 28.

The force adjusting mechanism in FIGS. 28 and 29 includes a piston 250 that is threadedly coupled on and driven by piston driving rod 251. The piston 250 and piston driving rod 251 are contained in bore 60' of the static hinge bracket 61. The top of the piston driving rod 251 includes pin receiving bores 252 by which the piston driving rod 251 is coupled to upper locking plug 253 that includes similar pin receiving bores 254 whereby pins (not shown) received in pin receiving bores 252 and 254 prevent relative rotation between the piston driving rod 251 and upper locking plug 253. Upper locking plug 252 is received in upper bore 58 of pivot hinge bracket 33 and secured therein by a pin or other fastening member (not shown) that is received in bores 255 and 256. The upper end of the piston driving rod 251 includes a groove 257 for receiving o-ring 259 to create a fluid seal.

The lower end of the piston drive rod 251 includes threads 260 that are received in threaded bore 261 of piston 250 and a groove 263 for receiving o-ring 264 to create a fluid seal.

A sealing plug 265 seals the bottom of bore 60' and includes groove 266 for receiving o-ring 267 to create a fluid seal. The sealing plug 265 includes pin receiving bores 268 by which the sealing plug 265 is coupled to lower locking plug 270 that includes similar pin receiving bores 271 whereby pins (not shown) received in pin receiving bores 268 and 271 prevent relative rotation between the sealing plug 265 and lower locking plug 270. Lower locking plug 270 is received in lower bore 35 of pivot hinge bracket 33 and secured therein by a pin or other fastening member (not shown) that is received in bores 273 and 274. Torsion bar 4 is received and secured in the bottom of lower locking plug 270 by a set screw, pin or other mechanical fastener (not shown).

As the door (not shown) moves between a closed and open position piston drive rod 251 rotates and causes piston 250 to move upward and downward in bore 60'. By configuring the shape of in bore 60' and/or piston 250 fluid pressure acting on the piston 250 can be controlled to effect control of the closing force that is generated when the torsion bar 4 is twisted when the door is opened. Bore 60' and piston 250 have similar non-circular shapes for piston 250 does not rotate within bore 60'.

Friction discs 275 and friction plate 276 cooperate under fluid pressure as piston 250 moves upward to engage 252 below 257 and create resistance against rotation of piston drive rod 251.

As can be understood, generally the hinge and force adjusting or controlling mechanism of the present invention can be adapted for use exteriorly or interiorly of doors by appropriately a bore within a static hinge bracket exteriorly of a door or a similar bore within a chamber that is fixed inside a door with similar elements within either bore configuration.

It is also within the scope of the present invention to provide some or all the elements of the force adjusting or controlling mechanisms in other than vertical alignment by using right-angled gear assemblies.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. In a door assembly having a door and a door frame and a door hinge mechanism the improvement comprising:

a torsion bar about which the door rotates between an open and a closed position wherein one end of the torsion bar is attached to the door frame so as not to rotate with respect to the door frame and another end of the torsion bar is fixedly attached to the door so as to become twisted as the door is pivoted between open and closed positions, whereby when the door is moved between the closed and open positions the torsion bar twists between the ends thereof so as to build-up potential energy in the torsion bar; and a force adjustment mechanism which releases built-up potential energy in the torsion bar in a controlled manner so as to close the door in a controlled manner, wherein the door hinge mechanism includes a static hinge bracket having a structure defining a central bore one side and a pivotal hinge bracket having structures defining upper and lower bores on one side, the static hinge bracket being attached to the door frame and the pivotal hinge bracket attached to the door, and the central bore of the static hinge bracket axially aligned with and between the upper and lower bores of the pivotal hinge bracket to receive the force adjusting mechanism in the aligned central, upper and lower bores with the torsion bar coupled to and extending outward from one of the upper or lower bores without extending into the central bore, whereby the torsion bar rotates with the pivotal hinge bracket.

2. A door assembly according to claim 1, wherein the force adjustment mechanism comprises a thrust bearing.

3. A door assembly according to claim 1, wherein the force adjustment mechanism comprises a piston that is configured to rotate with the another end of the torsion bar.

4. A door assembly according to claim 1, wherein the torsion bar is provided on an external surface of the door.

5. A door assembly according to claim 1, wherein the torsion bar is provided within an Interior area of the door.

6. A door assembly according to claim 1, wherein the torsion bar is provided within an interior area of the door frame.

7. A door assembly according to claim 1, wherein the torsion bar comprises two torsion bars.

8. A door assembly according to claim 1, wherein the torsion bar twists when the door is moved from the open position to the closed position.

9. A door assembly according to claim 1, wherein the force adjustment mechanism releases built-up potential energy in the torsion bar in a rate that is non-linear.

10. A door assembly according to claim 1, further comprising an assembly for adjustably pre-loading torque on the torsion bar.

11. In a closure assembly having a closure that is configured to close an opening defined by a surrounding structure and a closure hinge mechanism the improvement comprising:

a torsion bar about which the closure rotates between an open and a closed position wherein one end of the torsion bar is attached to the surrounding structure so as not to rotate with respect to the surrounding structure and another end of the torsion bar is fixedly attached to the closure so as to become twisted as the closure is pivoted between open and closed positions, whereby when the closure is moved between the open and closed positions the torsion bar twists between the ends thereof so as to build-up potential energy in the torsion bar, and a force adjustment mechanism which releases built-up potential energy in the torsion bar in a controlled manner so as to close or open the closure in a controlled manner, wherein the door hinge mechanism includes a static hinge bracket having a structure defining a central bore on one side and a pivotal hinge bracket having structures defining upper and lower bores on one side, the static hinge bracket being attached to the surrounding structure and the pivotal hinge bracket attached to the closure, and the central bore of the Static hinge bracket axially aligned with and between the upper and lower bores of the pivotal hinge bracket to receive the force adjusting mechanism in the aligned central, upper and lower bores with the torsion bat coupled to and extending outward from one of the upper or lower bores without extending into the central bore, whereby the torsion bar rotates with the pivotal hinge bracket.

12. The closure assembly of claim 11, wherein the closure is a door.

13. The closure assembly of claim 11, wherein the closure is a lid.

* * * * *